US006718245B2

(12) United States Patent
Watanabe et al.

(10) Patent No.: US 6,718,245 B2
(45) Date of Patent: Apr. 6, 2004

(54) ELECTRONIC CONTROL SYSTEM FOR CONSTRUCTION MACHINERY

(75) Inventors: Hiroshi Watanabe, Ushiku (JP); Hidefumi Ishimoto, Tsuchiura (JP); Hiroshi Ogura, Ryugasaki (JP); Hiroyuki Adachi, Tsuchiura (JP)

(73) Assignee: Hitachi Construction Machinery Co., Ltd., Tokyo (JP)

( * ) Notice: Subject to any disclaimer, the term of this patent is extended or adjusted under 35 U.S.C. 154(b) by 13 days.

(21) Appl. No.: 10/070,989

(22) PCT Filed: Jul. 13, 2001

(86) PCT No.: PCT/JP01/06085

§ 371 (c)(1),
(2), (4) Date: Mar. 14, 2002

(87) PCT Pub. No.: WO02/06592

PCT Pub. Date: Jan. 24, 2002

(65) Prior Publication Data

US 2002/0138188 A1 Sep. 26, 2002

(51) Int. Cl.[7] ..... E02F 9/20
(52) U.S. Cl. ..... 701/50; 37/414
(58) Field of Search ..... 701/50, 24, 32; 37/414; 222/63

(56) References Cited

U.S. PATENT DOCUMENTS 6,167,337 A * 12/2000 Haack et al. ..... 701/50
6,336,067 B1 * 1/2002 Watanabe et al. ..... 701/50

FOREIGN PATENT DOCUMENTS

| | | |
|---|---|---|
| JP | 7-110287 | 4/1995 |
| JP | 7-113854 | 12/1995 |
| JP | 8-28911 | 3/1996 |
| JP | 2922004 | 4/1999 |

OTHER PUBLICATIONS

SAE Technical Paper, No. 941796, "Development of Intelligent Hydraulic Excavator—Hyper GX Series", 1994.

* cited by examiner

*Primary Examiner*—Marthe Y. Marc-Coleman
(74) *Attorney, Agent, or Firm*—Mattingly, Stanger & Malur, P.C.

(57) ABSTRACT

A system having a monitoring function in addition to a control function is able to suppress an increase in the amount of data communication and the communication frequency via a common communication line, and is flexibly adaptable for the addition of a new function without causing mutual interference between control data and monitor data. In particular, a hydraulic excavator 1 includes a first control unit 17 for a prime mover 14, a second control unit 23 for a hydraulic pump 18, a third control unit 33 for control valves 24, 25 and 26, and first and second monitor units 45, 46. A first common communication line 39 for control and a second common communication line 40 for monitoring are further provided as common buses for data communication.

6 Claims, 42 Drawing Sheets

FIG.7

COMMUNICATION DATA VIA COMMON COMMUNICATION LINE IN FIRST EMBODIMENT

| COMMUNICATION DATA NAME | | | CONTROL-SYSTEM COMMON COMMUNICATION LINE (FIRST COMMON COMMUNICATION LINE) | | | | MONITOR-SYSTEM COMMON COMMUNICATION LINE (SECOND COMMON COMMUNICATION LINE) | | | |
|---|---|---|---|---|---|---|---|---|---|---|
| ID No | DATA NAME | SYM-BOL | FIRST CONTROL UNIT | SECOND CONTROL UNIT | THIRD CONTROL UNIT | COMMUNI-CATION PERIOD | FIRST MONITOR UNIT | SECOND MONITOR UNIT | FIRST CONTROL UNIT | COMMUNI-CATION PERIOD |
| 101 | TARGET ENGINE REVOLUTION SPEED | Nr | ○ | ● | | 50mS | | | | |
| 102 | ENGINE REVOLUTION SPEED | Ne | ○ | ● | | 20mS | ● | ● | ○ | 100mS |
| 103 | ENGINE OIL PRESSURE | Poil | | | | | ● | ● | ○ | 1S |
| 104 | COOLING WATER TEMPERATURE | Tw | | | | | ● | ● | ○ | 1S |
| 201 | PUMP DELIVERY PRESSURE | Pd | | | | | | | | |
| 202 | PUMP TILTING ANGLE | θ | | | | | | | | |
| 301 | OPERATION SIGNAL | X1 | | ● | ○ | 10mS | | | | |
| 302 | 〃 | X2 | | ● | ○ | 10mS | | | | |
| 303 | 〃 | X3 | | ● | ○ | 10mS | | | | |
| 401 | FILTER PRESSURE | Pflt | | | | | ○ | ● | | 1S |
| 402 | FUEL LEVEL | Fuel | | | | | ○ | ● | | 1S |

TRANSMIT : ○

RECEIVE : ●

FIG.19

EEPROM

RECORD OF ENGINE OPERATION

'2000.1.27 AM08:01 START

'2000.1.27 AM11:59 STOP

'2000.1.28 AM09:10 START

'2000.1.28 PM04:30 STOP

.

.

.

RECORD OF ACCUMULATED ENGINE OPERATION

1250hr

ENGINE OIL PRESSURE ANOMALY

'2000.1.27 AM10:00 ON

'2000.1.27 AM10:05 OFF

FILTER PRESSURE ANOMALY

'2000.1.28 AM11:00 ON

'2000.1.28 PM01:20 OFF

FUEL-REMAINNING-AMOUNT WARNING

'2000.1.28 AM10:00 ON

'2000.1.28 AM11:00 OFF

FREQUENCY DISTRIBUTION OF COOLING WATER TEMPERATURE $Tw \geqq Tmax$ : 10hr $Tmax > Tw \geqq T2$ : 190hr $T2 > Tw \geqq T1$ : 310hr $T1 > Tw \geqq T0$ : 520hr $T0 > Tw$ : 220hr

FIG.28

COMMUNICATION DATA VIA COMMON COMMUNICATION LINE IN SECOND EMBODIMENT

| COMMUNICATION DATA NAME | | | CONTROL-SYSTEM COMMON COMMUNICATION LINE (FIRST COMMON COMMUNICATION LINE) | | | | MONITOR-SYSTEM COMMON COMMUNICATION LINE (SECOND COMMON COMMUNICATION LINE) | | | | |
|---|---|---|---|---|---|---|---|---|---|---|---|
| ID No | DATA NAME | SYM-BOL | FIRST CONTROL UNIT | SECOND CONTROL UNIT | THIRD CONTROL UNIT | COMMUNI-CATION PERIOD | FIRST MONITOR UNIT | SECOND MONITOR UNIT | FIRST CONTROL UNIT | DISPLAY DEVICE | COMMUNI-CATION PERIOD |
| 101 | TARGET ENGINE REVOLUTION SPEED | Nr | ○ | ● | | 50mS | | | | | |
| 102 | ENGINE REVOLUTION SPEED | Ne | ○ | ● | | 20mS | | ● | ○ | ● | 100mS |
| 103 | ENGINE OIL PRESSURE | Poil | | | | | | ● | ○ | ● | 1S |
| 104 | COOLING WATER TEMPERATURE | Tw | | | | | | ● | ○ | ● | 1S |
| 201 | PUMP DELIVERY PRESSURE | Pd | | | | | | | | | |
| 202 | PUMP TILTING ANGLE | θ | | | | | | | | | |
| 301 | OPERATION SIGNAL | X1 | | ● | ○ | 10mS | | | | | |
| 302 | 〃 | X2 | | ● | ○ | 10mS | | | | | |
| 303 | 〃 | X3 | | ● | ○ | 10mS | | | | | |
| 401 | FILTER PRESSURE | Pflt | | | | | ○ | ● | | ● | 1S |
| 402 | FUEL LEVEL | Fuel | | | | | ○ | ● | | ● | 1S |
| 501 | WORK TIME | Tmwork | | | | | | ○ | | ● | UPON DISPLAY OPERATION |
| 502 | TIME-OF-DAY | Time | | | | | | ○ | | ● | UPON DISPLAY OPERATION |
| 503 | WATER TEMPERATURE FREQUENCY DISTRIBUTION | HisTw | | | | | | ○ | | ● | UPON DISPLAY OPERATION |
| 504 | ANOMALY DETECTION HISTORY | HisW | | | | | | ○ | | ● | UPON DISPLAY OPERATION |

TRANSMIT : ○

RECEIVE : ●

SCRREN 1

SCRREN 2

SCRREN 3

FIG.37

COMMUNICATION DATA VIA COMMON COMMUNICATION LINE IN THIRD EMBODIMENT

| COMMUNICATION DATA NAME | | | CONTROL-SYSTEM COMMON COMMUNICATION LINE (FIRST COMMON COMMUNICATION LINE) | | | | | | MONITOR-SYSTEM COMMON COMMUNICATION LINE (SECOND COMMON COMMUNICATION LINE) | | | | | |
|---|---|---|---|---|---|---|---|---|---|---|---|---|---|---|
| ID No | DATA NAME | SYM-BOL | FIRST CONTROL UNIT | SECOND CONTROL UNIT | THIRD CONTROL UNIT | FOURTH CONTROL UNIT | DISPLAY DEVICE | COMMUNI-CATION PERIOD | FIRST MONITOR UNIT | SECOND MONITOR UNIT | FIRST CONTROL UNIT | FOURTH CONTROL UNIT | DISPLAY DEVICE | COMMUNI-CATION PERIOD |
| 101 | TARGET ENGINE REVOLUTION SPEED | Nr | ○ | ● | | | | 50mS | | | | | | |
| 102 | ENGINE REVOLUTION SPEED | Ne | ○ | ● | | | | 20mS | | ● | ○ | | ● | 100mS |
| 103 | ENGINE OIL PRESSURE | Poil | | | | | | | | ● | ○ | | ● | 1S |
| 104 | COOLING WATER TEMPERATURE | Tw | | | | | | | | ● | ○ | | ● | 1S |
| 201 | PUMP DELIVERY PRESSURE | Pd | | | | | | | | | | | | |
| 202 | PUMP TILTING ANGLE | θ | | | | | | | | | | | | |
| 301 | OPERATION SIGNAL | X1 | | ● | ○ | ● | | 10mS | | | | | | |
| 302 | 〃 | X2 | | ● | ○ | ● | | 10mS | | | | | | |
| 303 | 〃 | X3 | | ● | ○ | ● | | 10mS | | | | | | |
| 701 | DRIVE SIGNAL | Yβ | | | ● | ○ | | 10mS | | | | | | |
| 702 | 〃 | Yα | | | ● | ○ | | 10mS | | | | | | |
| 703 | 〃 | Yγ | | | ● | ○ | | 10mS | | | | | | |
| 704 | BOOM ANGLE | β | | | | | | | | | | ○ | ● | 100mS |
| 705 | ARM AMGLE | α | | | | | | | | | | ○ | ● | 100mS |
| 706 | BUCKET ANGLE | γ | | | | | | | | | | ○ | ● | 100mS |
| 707 | BUCKET FORE END DEPTH | hx | | | | | | | | | | ○ | ● | 100mS |
| 708 | BUCKET FORE END LEACH | hy | | | | | | | | | | ○ | ● | 100mS |
| 401 | FILTER PRESSURE | Pflt | | | | | | | ○ | ● | | | ● | 1S |
| 402 | FUEL LEVEL | Fuel | | | | | | | ○ | ● | | | ● | 1S |
| 501 | WORK TIME | Tmwork | | | | | | | | ○ | | | ● | UPON DISPLAY OPERATION |
| 502 | TIME-OF-DAY | Time | | | | | | | | ○ | | | ● | UPON DISPLAY OPERATION |
| 503 | WATER TEMPERATURE FREQUENCY DISTRIBUTION | HisTw | | | | | | | | ○ | | | ● | UPON DISPLAY OPERATION |
| 504 | ANOMALY DETECTION HISTORY | HisW | | | | | | | | ○ | | | ● | UPON DISPLAY OPERATION |
| 505 | OPERATING TIME | TMop | | | | | | | | ○ | | | ● | UPON DISPLAY OPERATION |
| 601 | TARGET LOCUS | hr | | | | ● | ○ | 100mS | | | | | | 100mS |
| 602 | AUTOMATIC OPERATION COMMAND | Cauto | | | | ● | ○ | 100mS | | | | | | 100mS |

TRANSMIT : ○ RECEIVE : ●

SCREEN 4

SCREEN 5

ELECTRONIC CONTROL SYSTEM FOR CONSTRUCTION MACHINERY

TECHNICAL FIELD

The present invention relates to an electronic control system for a construction machine, and more particularly to an electronic control system for a construction machine comprising a prime mover, hydraulic equipment and systems, and a working device, the construction machine further comprising a plurality of control units divided for each function and at least one monitor unit for monitoring the status of the construction machine, the plurality of control units and the monitor unit being connected to each other for transmission and reception of data.

BACKGROUND ART

Recently, a keen demand has existed for an improvement of performance or a more variety of applications of a construction machine, particularly a hydraulic excavator as a typical example thereof, and electronic control has been progressed to cope with such a demand. In that situation, an electronic control system is required to be able to execute processing at high rate, and a control unit must be constituted using an advanced microcomputer, thus resulting in an increased cost. Also, with an increase in the number of input/output signals handled by a system, a control unit and a wire harness are complicated. To deal with those problems, distribution of control units is studied in which control functions of a hydraulic excavator are divided into individual unit functions, control units are provided in a one-to-one relation to the unit functions, and the control units are interconnected via a network for control of the entire machine.

For example, JP,B 7-113854 discloses an electronic control system for a hydraulic excavator, wherein control units are provided in a one-to-one relation to plural pieces of equipment, the control units respectively associated with the plural pieces of equipment are connected to a master controller via a common communication line, and the master controller performs integrated control of the entire system.

Further, JP,B 8-28911 discloses an electronic control system for a construction machine, wherein control units are provided in a one-to-one relation to plural pieces of equipment, and the control units are interconnected by a multiplex-transmission serial communication circuit to constitute a network allowing two-way communication for easier extension of the system. This publication also discloses an arrangement that a display monitor for displaying the operating status of the system is connected to the multiplex-transmission serial communication circuit.

Moreover, SAE Paper 941796 Development of Intelligent Hydraulic Excavator—HYPER GX Series (issued in 1994) discloses an electronic control system for a hydraulic excavator, wherein control units are provided in a one-to-one relation to plural pieces of equipment, the control units ate interconnected via a network, and the network is divided into a low-rate network and a high-rate network (bus) for ensuring reliability of high-rate communication data.

On the other hand, in a construction machine such as a hydraulic excavator, monitoring functions are increasingly demanded, in addition to functions for control purpose, such as represented by recording machine operation data and monitoring the operating status for maintenance of a machine body, or displaying the status of a working device for assistance to operator work. For example, JP,A 7-110287 discloses a system for recording machine operation data in the compressed form and monitoring the operating status for maintenance of a machine body.

DISCLOSURE OF THE INVENTION

The above-mentioned prior-art control systems, however, have problems as follows.

In a construction machine, particularly a hydraulic excavator as a typical example thereof, the amount of data to be handled by a control unit and the update frequency (communication rate) of the data have increased with the progress of electronic control. Also, monitoring functions are increasingly demanded, in addition to functions for control purpose, such as represented by recording machine operation data for maintenance of a machine body, or displaying the status of a working device for assistance to operator work. Thus, not only the amount of data used for control, but also the amount of data used for monitoring has increased. When the above-mentioned prior-art control systems are employed in such a situation, there arise several problems described below.

In the distributed control system disclosed in JP,B 7-113854, the control units provided in a one-to-one relation to the plural pieces of equipment transmit all data to the master controller via the common communication line. The master controller processes those data in a batch manner, and then transmits control commands to the control units. If a monitoring function is added to that system, the amount of data communication between the control units and the master controller would be greatly increased because the master controller would have to handle all of control data and monitor data. Therefore, a common communication line capable of communicating data at high rate and a master controller capable of executing high-rate processing would be both required in order to prevent an adverse effect upon the control performance that should be considered with top priority. This would necessarily lead to more complicated construction of system equipment and a higher cost of the system.

Further, because of the control data and the monitor data being transferred via the same common communication line, if any trouble occurs in either data, communication would be no longer continued due to the mutual effect between both types of data, and the system would be stopped in the worst case. Particularly, the control system must be avoided from being stopped upon the occurrence of a trouble in the monitor data.

In the distributed control system disclosed in JP,B 8-28911, the control units divided for each function are connected to a single multiplex-transmission serial communication line for mutual communication. Therefore, the amount of data communication is probably not so increased in this system as expected in the distributed control system disclosed in JP,B 7-113854. However, because the control data and the monitor data are transferred likewise via the same common communication line, there still remains a problem that if any trouble occurs in either data, communication would be no longer continued due to the mutual effect between both types of data, and the system would be stopped in the worst case.

Further, the amount of data communication and the communication frequency via the multiplex-transmission serial communication line are set to be optimum for control in a situation where the control data and the monitor data are present in a mixed manner. Accordingly, if a new control unit (function) is added, the amount of data communication and the communication frequency would have to be set again for an increase in communication data. Hence, this prior art cannot be said as a system flexibly adaptable for addition of a new function. It is particularly important to avoid an increase in the monitor data from adversely affecting the control data.

In the distributed control system disclosed in SAE Paper 941796 Development of Intelligent Hydraulic Excavator—HYPER GX Series, the network is divided into a low-rate network and a high-rate network. All control units of the system are connected to the low-rate network, which serves as a wide-area network. The use of the high-rate network is limited to the connection between the control units that require high-rate communication for the purpose of control. When adding a monitoring function to this system, however, control units for the monitoring are connected to the wide-area network because various kinds of monitor data must be handled. Consequently, as with the system disclosed in JP,B 8-28911, there accompany the problem of mutual interference between the control data and the monitor data, and the problem of insufficient flexibility for addition of a new function.

An object of the present invention is to provide an electronic control system for a construction machine, which has a control function and a monitoring function, and which can suppress an increase in the amount of data communication and the communication frequency via a single common communication line, and is flexibly adaptable for addition of a new function without causing mutual interference between control data and monitor data.

(1) To achieve the above object, the present invention provides an electronic control system for a construction machine comprising a prime mover, hydraulic equipment and systems, and a working device, the construction machine further comprising a plurality of control units divided for each function and at least one monitor unit for monitoring the operating status of the construction machine, the plurality of control units and the monitor unit being connected to each other for communication of control data and monitor data, wherein the electronic control system comprises at least two common communication lines including a first common communication line for communicating the control data and a second common communication line for communicating the monitor data; and the plurality of control units are connected to the first common communication line for communicating the control data among the plurality of control units via the first common communication line, and the monitor unit and a particular one of the plurality of control units are connected to the second common communication line for communicating the monitor data between the monitor unit and the particular control unit via the second common communication line.

By providing the first and second common communication lines such that a common communication line is divided into at least a line for control and a line for monitoring, the amount of communication data and the communication frequency are distributed to the two common communication lines, and an increase in the amount of data communication and the communication frequency via a single common communication line are suppressed. Therefore, a common communication line and a processing unit, which are capable of operating at extremely high rates, are not required, and individual pieces of component equipment can be avoided from being complicated and from having an increased cost.

Also, by dividing a common communication line into at least a line for control and a line for monitoring, mutual interference does not occur between the control data and the monitor data. Therefore, even if any trouble occurs in either control data or monitor data, both types of data are prevented from affecting each other. In particular, it is possible to prevent a machine body from being stopped upon a trouble occurred in communication of the monitor data.

Further, even if another monitor unit, for example, is additionally connected to the common communication line for monitoring for the purpose of function enhancement, the amount of communication data and the communication frequency to be handled via the common communication line for control are not affected, and the system is flexibly adaptable for addition of equipment.

(2) In above (1), preferably, the electronic control system further comprises a display device connected to the second common communication line and displaying the monitor data communicated via the second common communication line.

With that feature, the monitor data can be displayed to the operator without causing any influences upon the control performance.

(3) In above (2), preferably, the display device includes processing means for displaying the monitor data communicated via the second common communication line in graphical form.

With that feature, the displayed monitor data is more easily recognizable by the operator.

(4) In above (1), preferably, the electronic control system further comprises a display device connected to both the first and second common communication lines and selectively displaying the control data communicated via the first common communication line and the monitor data communicated via the second common communication line.

With that feature, not only the monitor data but also the control data can be displayed on the same display device. Even in a cab of a construction machine or the like having a relatively narrow space, therefore, it is possible to display the monitor data and the control data to the operator with a single unit of the display device. Also, since there is no need of installing the display device in plural number, the system cost is reduced.

(5) In above (4), preferably, the display device includes processing means for displaying at least one of the control data communicated via the first common communication line and the monitor data communicated via the second common communication line in graphical form.

With that feature, the monitor data and the monitor data can be displayed to the operator in a more easily recognizable manner.

(6) In above (4), preferably, the display device includes input means, generates a command signal for control and a command signal for monitoring in conjunction with contents of a display screen upon operation of the input means, transmits the command signal for control to a corresponding one of the plurality of control units via the first common communication line, and transmits the command signal for monitoring to the monitor unit via the second common communication line.

With that feature, both the control unit and the monitor unit can be operated from the display device, thus resulting in less intricacy in the operation.

BRIEF DESCRIPTION OF THE DRAWINGS

FIG. 7 shows, in the form of a table, communication data via a common communication line in the first embodiment.

FIG. 19 shows an example of data recorded in an EEPROM by the main process of the second monitor unit.

FIG. 28 shows, in the form of a table, communication data via a common communication line in the second embodiment.

FIG. 29(A) shows a screen 1, FIG. 29(B) shows a screen 2, and FIG. 29(C) shows a screen 3.

FIG. 37 shows, in the form of a table, communication data via a common communication line in the third embodiment.

FIG. 40(A) shows a screen 4 and FIG. 40(B) shows a screen 5.

BEST MODE FOR CARRYING OUT THE INVENTION

Embodiments of the present invention will be described below with reference to the drawings.

<First Embodiment>

Figure 1:
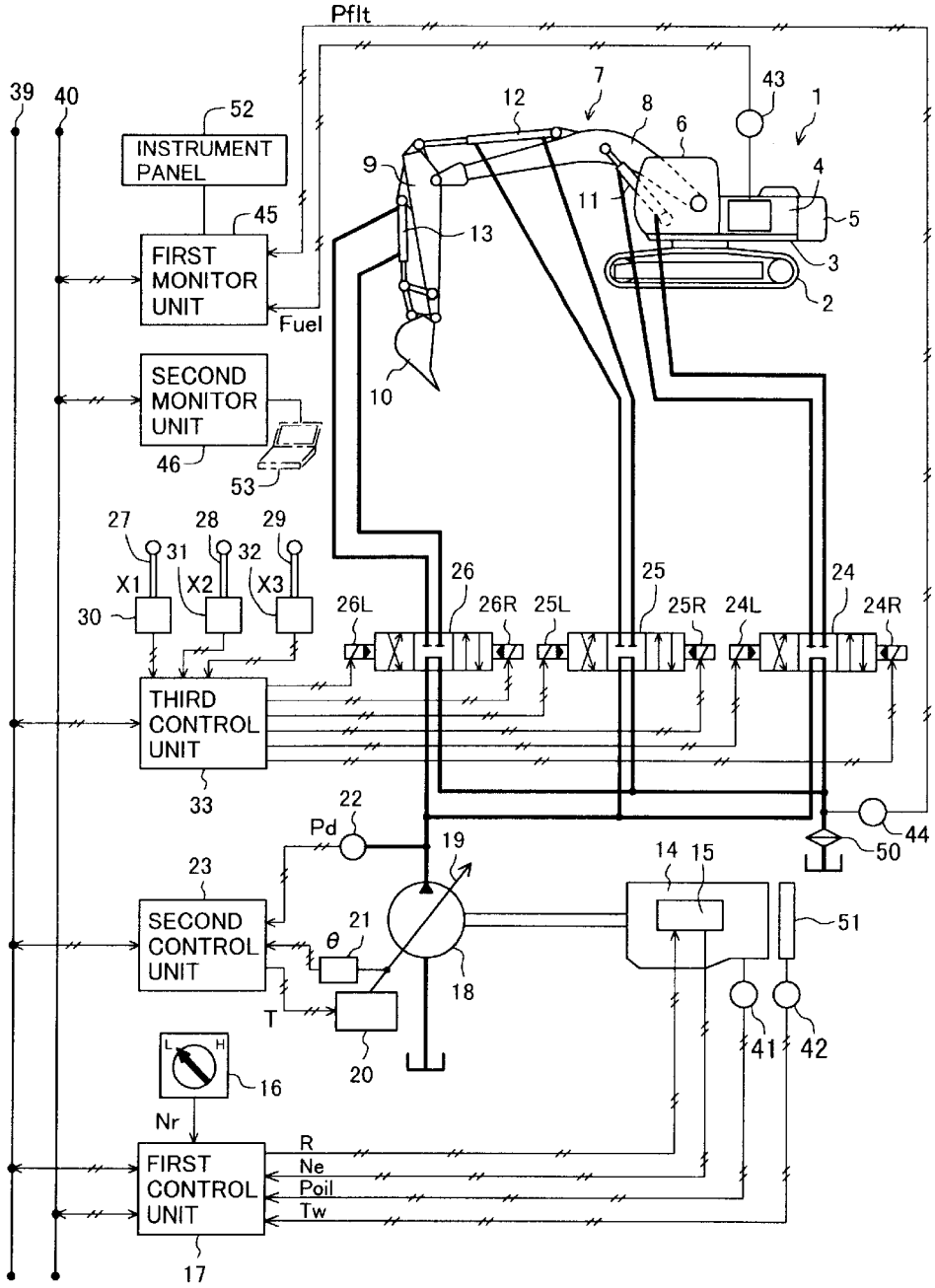
FIG. 1 is a diagram showing an electronic control system for a hydraulic excavator according to a first embodiment of the present invention along with the hydraulic excavator and a hydraulic system.

FIG. 1 is a diagram showing an electronic control system for a hydraulic excavator according to a first embodiment of the present invention along with the hydraulic excavator and a hydraulic system equipped on it. Referring to FIG. 1, numeral 1 denotes a hydraulic excavator, which comprises a track body 2, a swing body 3 rotatably mounted on the track body 2, an accommodating room 4 provided on the swing body 3 and accommodating a prime mover 14 and hydraulic equipment such as a hydraulic pump 18, a counterweight 5 disposed behind the swing body 3, a cab 6 provided in a front portion of the swing body 3 on the left side, and an excavating device 7 provided in the front portion of the swing body 3 at the center thereof.

The excavating device 7 comprises a boom 8 mounted to the swing body 3 in a rotatable manner to pivot up and down, an arm 9 rotatably mounted to a fore end of the boom 8, a bucket 10 rotatably mounted to a fore end of the arm 9, a boom operating hydraulic cylinder 11 for rotating the boom 8 up and down, an arm operating hydraulic cylinder 12 for rotating the arm 9, and a bucket operating hydraulic cylinder 13 for rotating the bucket 10.

The prime mover 14 is a diesel engine and includes an electronic governor 15 for maintaining the engine revolution speed of within a certain range. A target revolution speed Nr of the prime mover 14 is set by a target revolution-speed setting unit 16.

A hydraulic pump 18 is driven by the prime mover 14 for rotation. The hydraulic pump 18 is a variable displacement pump and includes a swash plate 19 for varying the pump delivery rate. A delivery rate adjusting device 20 is coupled to the swash plate 19. Also, there are provided a swash plate position sensor 21 for detecting a tilting position of the swash plate 19 and a pressure sensor 22 for detecting the delivery pressure of the hydraulic pump 18.

The prime mover 14 is provided with a first control unit 17. The control unit 17 executes predetermined computation based on the target revolution speed Nr from the target revolution-speed setting unit 16 and an actual revolution speed Ne detected by the governor 15, and outputs a control signal R to the governor 15 so that the actual revolution speed Ne is matched with the target revolution speed Nr.

The hydraulic pump 18 is provided with a second control unit 23. The second control unit 23 executes predetermined computation based on a delivery pressure Pd of the hydraulic pump 18 detected by the pressure sensor 22 and a tilting position θ of the swash plate 19 detected by the swash plate position sensor 21, and outputs a control signal T for the swash plate 19 to the delivery rate adjusting device 20 associated with the hydraulic pump 18.

The boom operating hydraulic cylinder 11, the arm operating hydraulic cylinder 12, and the bucket operating hydraulic cylinder 13 are connected to the hydraulic pump 18 through control valves 24, 25 and 26, respectively. The flow rates and directions at and in which a hydraulic fluid is supplied from the hydraulic pump 18 to the cylinders 11, 12 and 13 are adjusted by the control valves 24, 25 and 26, respectively.

Control levers 27, 28 and 29 are associated with the control valves 24, 25 and 26, and lever actuators 30, 31 and 32 are coupled to the control levers 27, 28 and 29, respectively. The lever actuators 30, 31 and 32 output, as operation signals X1, X2 and X3, electrical signals corresponding to shift amounts by which the control levers 27, 28 and 29 are operated, respectively.

The operation signals X1, X2 and X3 are inputted to a third control unit 33. The control unit 33 executes predetermined computation based on the operation signals X1, X2 and X3, and outputs control signals to actuating sectors 24L, 24R, 25L, 25R, 26L and 26R of the control valves 24, 25 and 26.

Further, the prime mover 14 is provided with an oil pressure sensor 41 for measuring the pressure of lubricating oil and a water temperature sensor 42 disposed on a radiator 51 for cooling engine cooling water. Signals representing an engine oil pressure Poil and a cooling water temperature Tw and detected by those sensors are inputted to the first control unit 17 and used for monitoring the anomaly status of the prime mover 14.

Moreover, the electronic control system includes other various sensors for monitoring the status of other equipment of the hydraulic excavator 1. In this embodiment, there are provided a fuel level sensor 43 for measuring the remaining amount of fuel and a pressure sensor 44 for detecting clogging of a filter 50 provided in a hydraulic circuit. Signals representing a fuel level Fuel and a filter pressure Pflt and detected by those sensors are inputted to a first monitor unit 45. The first monitor unit 45 displays the inputted information on an instrument panel 52, which is provided inside the cab 6, using meters, warning lamps, etc.

In addition, the electronic control system includes a second monitor unit 46 for memorizing the operating status of the hydraulic excavator 1. The second monitor unit 46 receives the signals outputted from the first monitor unit 45 and the first control unit 17 via communication, and processes the received signals, thereby measuring and storing the work time and the operating status of the hydraulic excavator 1 in a time-serial or statistical manner. The stored information can be outputted to an external device, such as a personal computer (PC) 53, by connecting it to the monitor unit 46.

As common buses for data communication, there are provided two buses, i.e., a first common communication line 39 for communicating control data and a second common communication line 40 for communicating monitor data. The control units 17, 23 and 33 are interconnected via the first common communication line 39 so that signals necessary for control (control data) are transmitted and received among those control units. Also, the monitor units 45, 46 and the first control unit 17 are interconnected via the second common communication line 40 so that signals necessary for monitoring (monitor data) are transmitted and received among those monitor and control units.

Figure 2:
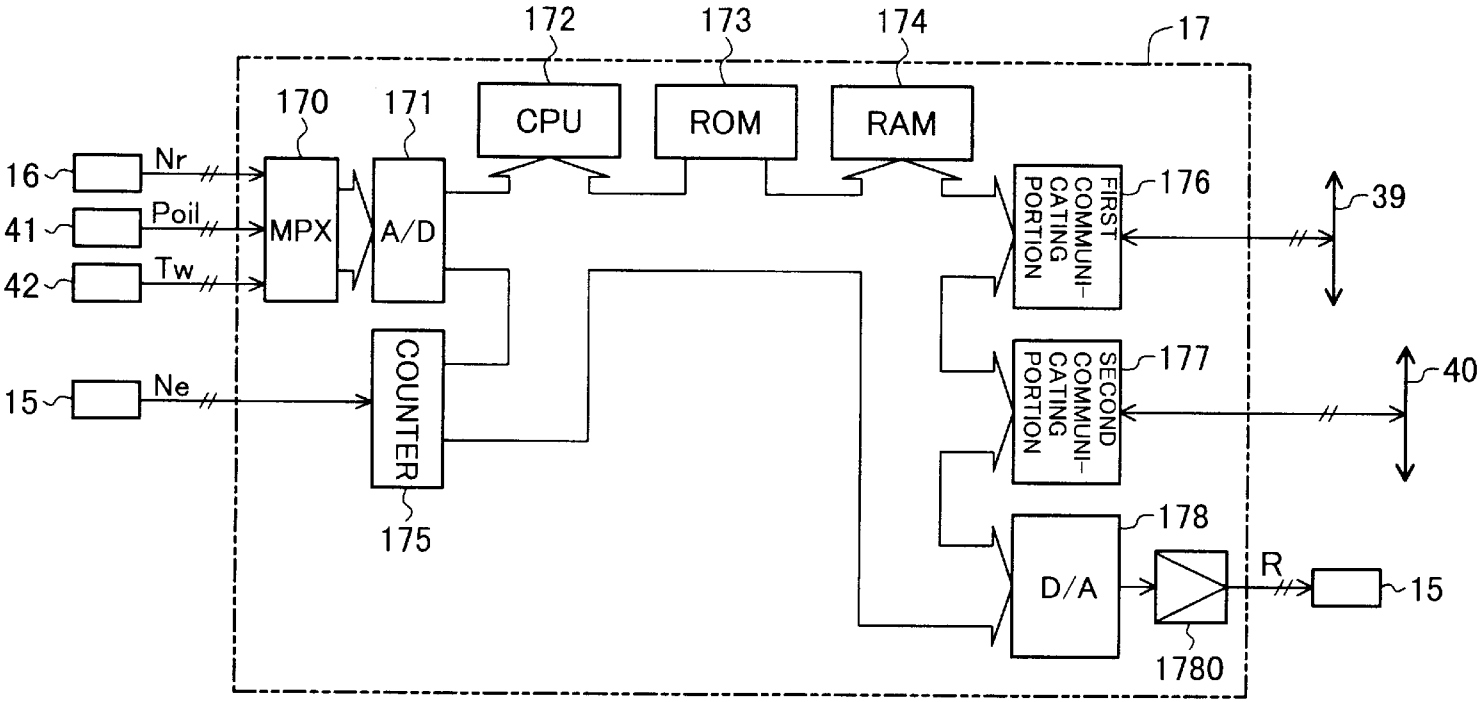
FIG. 2 is a block diagram showing a configuration of a first control unit shown in FIG. 1.

FIG. 2 shows a configuration of the first control unit 17. Referring to FIG. 2, the control unit 17 comprises a multiplexer 170 for outputting, to an A/D converter 171, a target revolution speed signal Nr from the target revolution-speed setting unit 16, an engine oil pressure signal Poil from the oil pressure sensor 41 and a cooling water temperature signal Tw from the water temperature sensor 42 in a switching manner; the A/D converter 171 for converting an analog signal inputted from the multiplexer 170 into a digital signal; a counter 175 for receiving the prime-mover actual revolution speed Ne from the governor 15; a central processing unit (CPU) 172 for controlling the whole of the control unit 17 in accordance with programs of control procedures and constants necessary for the control, which are stored in a ROM 173; the read only memory (ROM) 173 for storing the programs of control procedures executed by the CPU 172 and constants necessary for the control; a random access memory (RAM) 174 for temporarily storing numerical values obtained as computation results or in the course of computation; a D/A converter 178 for converting a digital signal into an analog signal; an amplifier 1780 for outputting a signal from the D/A converter to the governor 15; a first communicating portion 176 for controlling communication with the control units connected to the first common communicating line 39; and a second communicating portion 177 for controlling communication with the monitor unit or the control unit connected to the second common communicating line 40.

Figure 3:
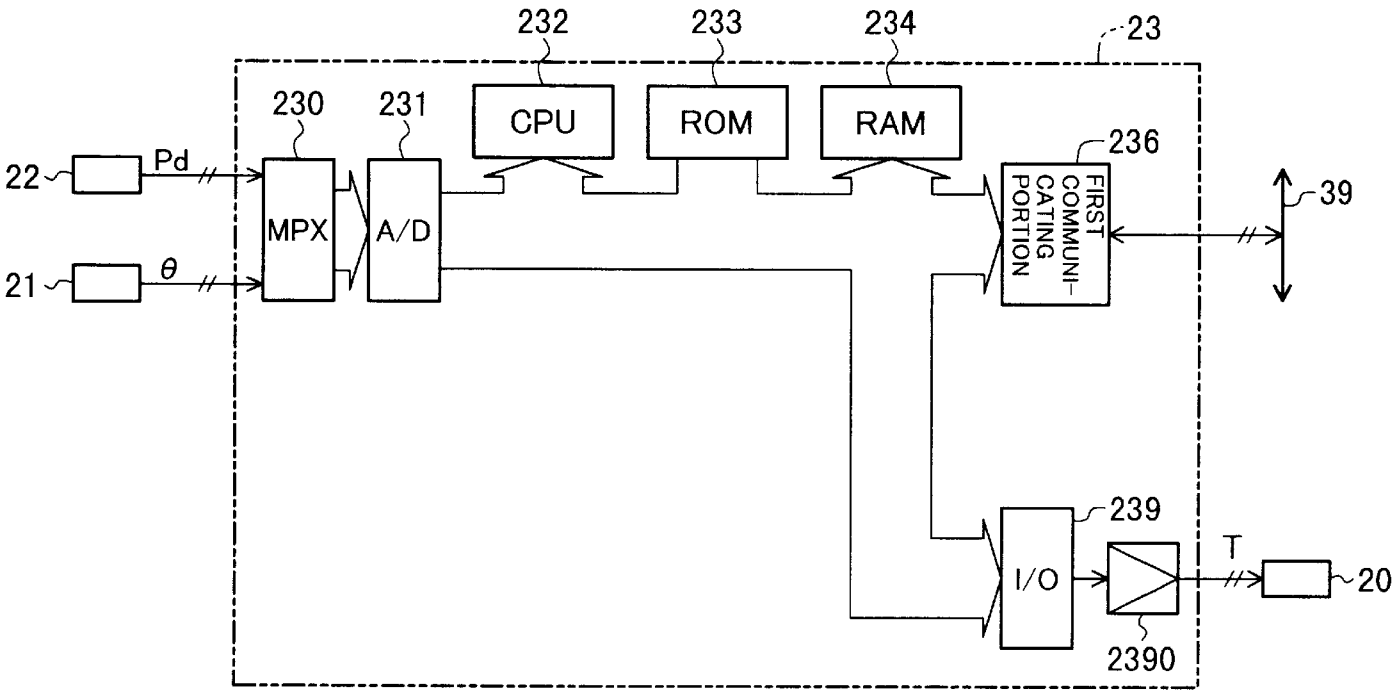
FIG. 3 is a block diagram showing a configuration of a second control unit shown in FIG. 1.

FIG. 3 shows a configuration of the second control unit 23. Referring to FIG. 3, the control unit 23 comprises a multiplexer 230 for outputting, to an A/D converter 231, a pressure signal Pd from the pressure sensor 22 and a swash plate position signal θ from the swash plate position sensor 21 in a switching manner; the A/D converter 231 for converting an analog signal inputted from the multiplexer into a digital signal; a central processing unit (CPU) 232; a read only memory (ROM) 233 for storing programs of control procedures and constants necessary for the control; a random access memory (RAM) 234 for temporarily storing numerical values obtained as computation results or in the course of computation; an interface (I/O) 239 for outputting a drive signal output for the swash plate 19 of the hydraulic pump 18 to the delivery rate adjusting portion 20 through a drive signal amplifier 2390; and a first communicating portion 236 for controlling communication with the control units connected to the first common communicating line 39.

Figure 4:
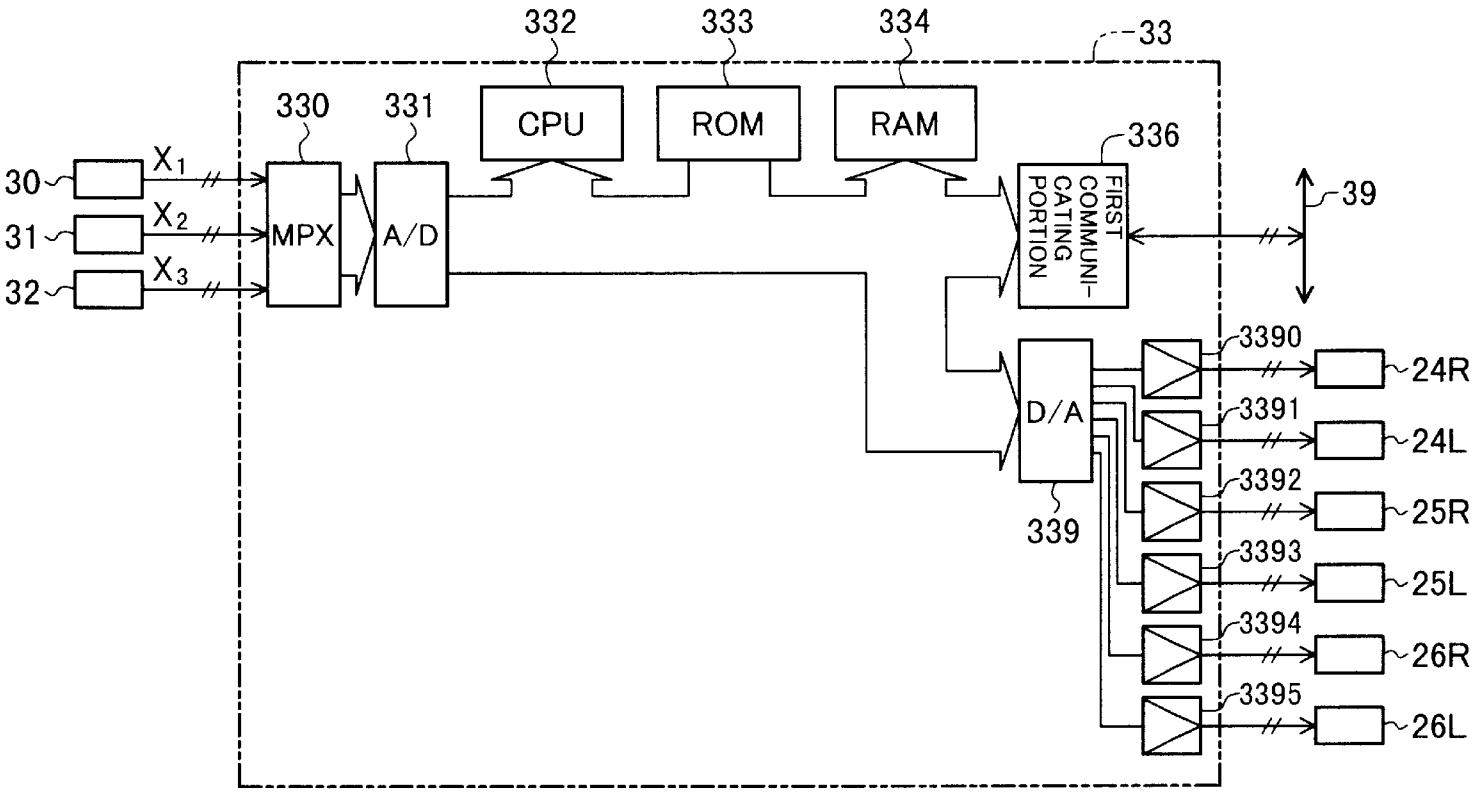
FIG. 4 is a block diagram showing a configuration of a third control unit shown in FIG. 1.

FIG. 4 shows a configuration of the third control unit 33. Referring to FIG. 4, the control unit 33 comprises a multiplexer 330 for outputting, to an A/D converter 331, the operation signals X1, X2 and X3 from signal generators 30, 31 and 32 of the electrical levers 27, 28 and 29; the A/D converter 331 for converting an analog signal inputted from the multiplexer 330 into a digital signal; a central processing unit (CPU) 332 for controlling the whole of the control unit in accordance with programs of control procedures and constants necessary for the control, which are stored in a ROM 333; a random access memory (RAM) 334 for temporarily storing numerical values obtained as computation results or in the course of computation; a D/A converter 339 for converting a digital drive signal into an analog signal and outputting respective drive signals through amplifiers 3390–3395 to proportional solenoid valves 24R, 24L, 25R, 25L, 26R and 26L associated with the control valves 24, 25 and 26; and a first communicating portion 336 for controlling communication with the control units connected to the first common communicating line 39.

Figure 5:
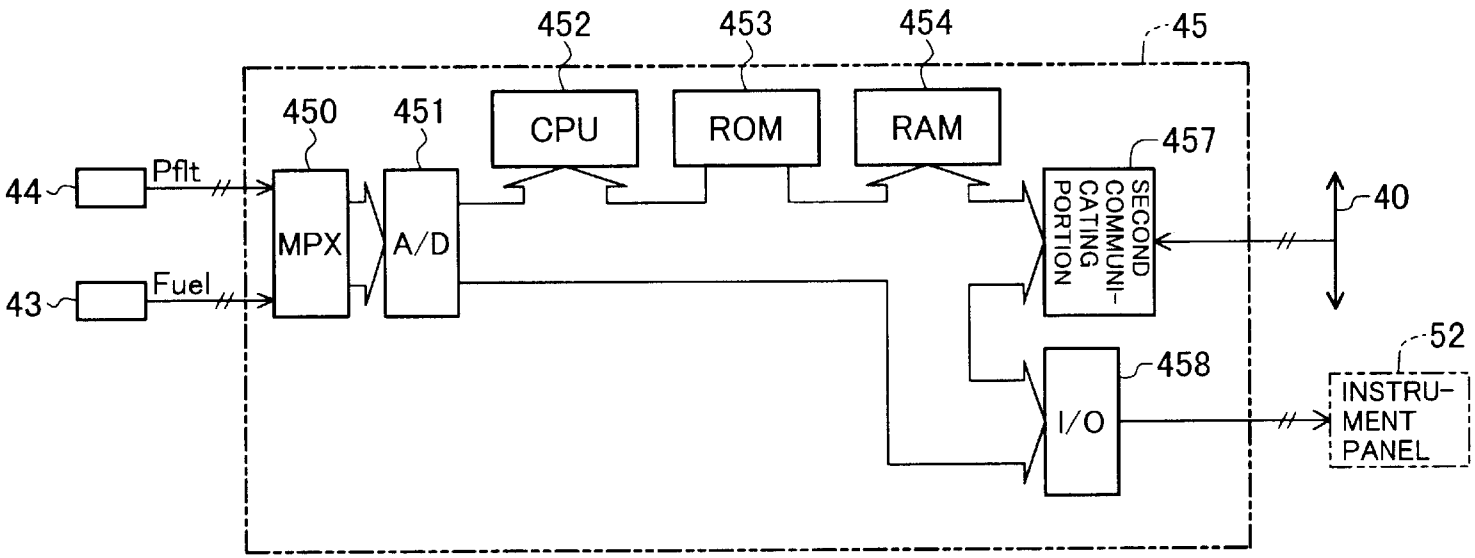
FIG. 5 is a block diagram showing a configuration of a first monitor unit shown in FIG. 1.

FIG. 5 shows a configuration of the first monitor unit 45. Referring to FIG. 5, the monitor unit 45 comprises a multiplexer 450 for outputting, to an A/D converter 451, a filter pressure signal Pflt from the pressure sensor 44 and a fuel level signal Fuel from the fuel level sensor 43 in a switching manner; the A/D converter 451 for converting an analog signal inputted from the multiplexer into a digital signal; a central processing unit (CPU) 452 for controlling the whole of the monitor unit in accordance with programs of monitoring procedures and constants necessary for computation, which are stored in a ROM 453; the read only memory (ROM) 453 for storing the programs of monitoring procedures and constants necessary for the computation; a random access memory (RAM) 454 for temporarily storing numerical values obtained as computation results or in the course of the computation; an interface (I/O) 458 for delivering outputs, to the instrument panel 52, in accordance with the fuel level signal, the filter pressure signal or other signals inputted from the other control units and monitor unit; and a second communicating portion 457 for controlling communication with the monitor unit or the control unit connected to the second common communicating line 40.

Figure 6:
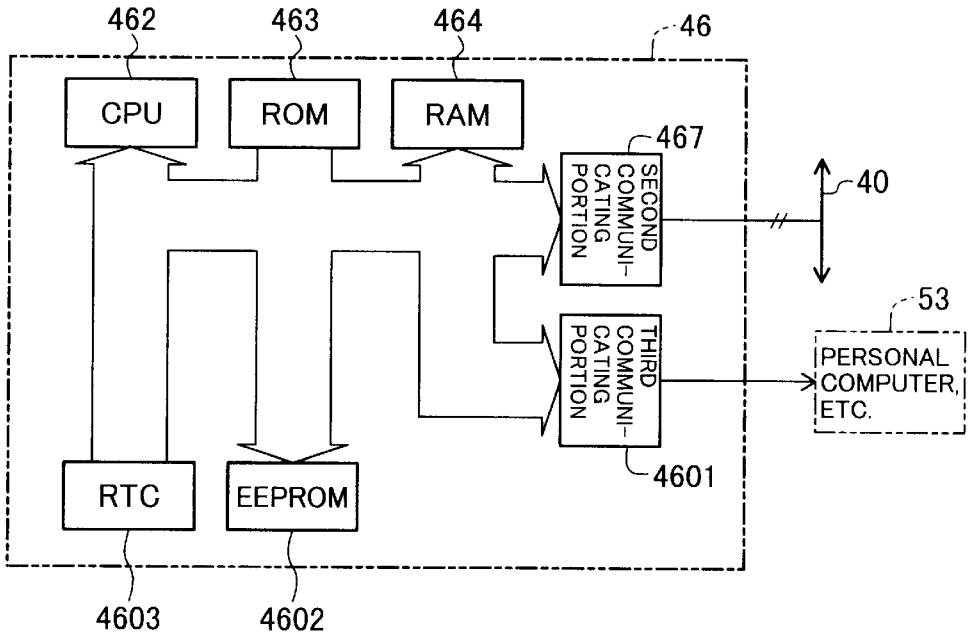
FIG. 6 is a block diagram showing a configuration of a second monitor unit shown in FIG. 1.

FIG. 6 shows a configuration of the second monitor unit 46. Referring to FIG. 6, the monitor unit 46 comprises a central processing unit (CPU) 462 for controlling the whole of the monitor unit in accordance with programs of monitoring procedures and constants necessary for computation, which are stored in a ROM 463; the read only memory (ROM) 463 for storing the programs of monitoring procedures and constants necessary for the computation; a random access memory (RAM) 464 for temporarily storing numerical values obtained as computation results or in the course of the computation; a writable nonvolatile memory (EEPROM) 4602 for storing monitoring data obtained by processing signals inputted from the first control unit 17 and the monitor unit 45; a real time clock (RTC) 4603 for outputting the current time-of-day; a second communicating portion 467 for controlling communication with the monitor unit or the control unit connected to the second common communicating line 40; and a third communicating portion 4601 for communicating the monitoring data stored in the EEPROM 4602 to an external device, such as the PC 53.

Next, communications via the first and second common communication lines 39, 40 will be described below.

FIG. 7 shows data communicated via the first and second common communication lines 39, 40. In a table of FIG. 7, ID No. denotes an identification number assigned to each item of data. A mark ○ represents data transmitted from the control unit, and a mark ● represents data received by the control unit. A period indicates an interval at which the control unit transmitting data communicates the data, i.e., a time interval at which data is updated. The period is decided in consideration of a time interval required for the relevant data from the standpoint of control or monitoring, or a change rate of the relevant data. Looking at the control unit 17, for example, the transmission period of about 50 mS is satisfactory for the target revolution speed Nr of the prime mover 14 because the target revolution speed Nr is hardly changed once set, and the actual revolution speed Ne of the prime mover 14 is desirably communicated at a period of 20 mS in consideration of a varying rate thereof. Also, since the operation signals X1, X2 and X3 transmitted from the control unit 33 are required for computing a target tilting angle θr of the hydraulic pump in the control unit 23, the transmission period of those signals is required to be about 10 mS.

Figure 8:
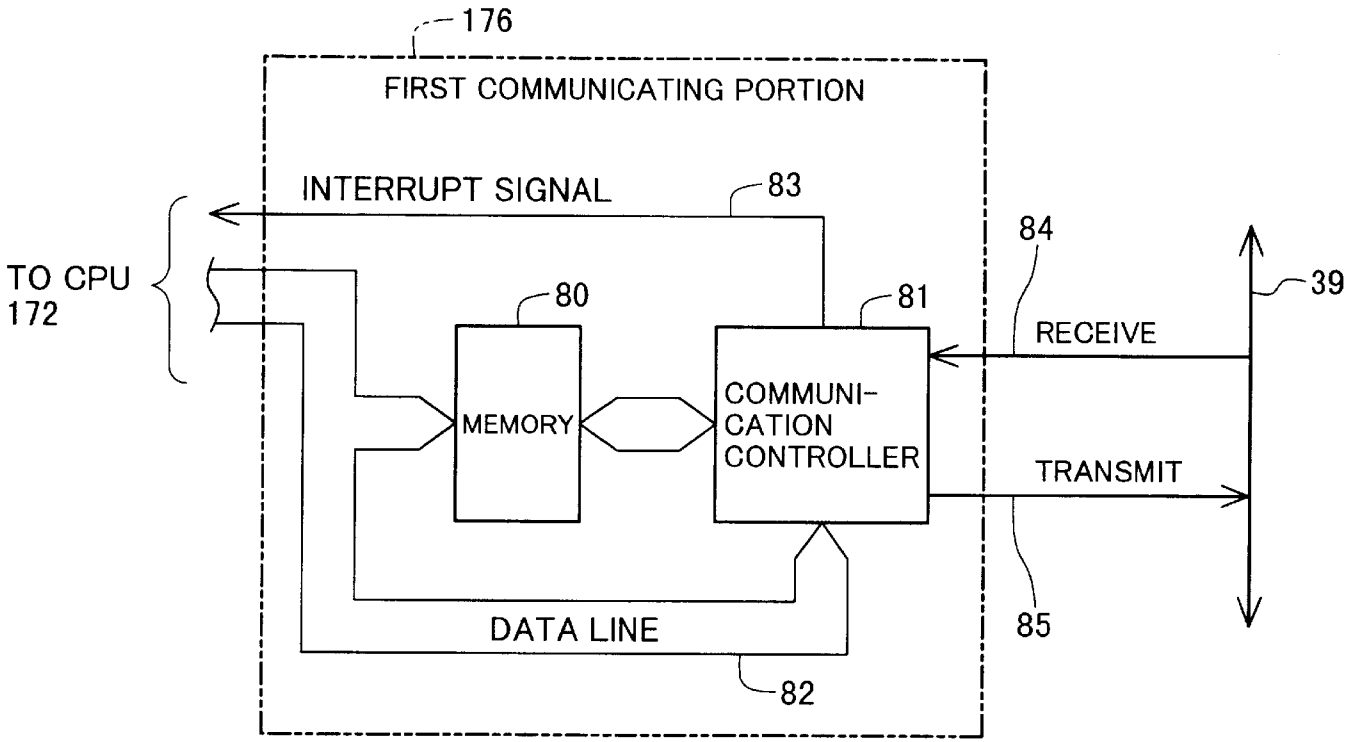
FIG. 8 is a block diagram showing a configuration of a first and second communicating portion.

FIG. 8 shows one example of a configuration of the first communicating portion 176 in the control unit 17. In FIG. 8, the same symbols as those in FIGS. 1 and 2 denote the same components. The first communicating portion 176 comprises a memory 80 having storage locations defined such that data is managed using the same number as ID No. assigned to individual data, a communication controller 81, a data line 82 connected to the CPU 172 in the control unit 17, an interrupt signal line 83 for sending a reception interrupt signal to the CPU 172 from the communication controller 81, and a reception line 84 and a transmission line 85 for connecting the communication controller 81 and the first common communication line 39 to each other.

The second communicating portion 177 in the control unit 17 and the first and second communicating portions in the other control units and monitor units are each similarly constructed.

Transmission and reception of data via the first and second common communication lines 39, 40 will now be described.

Figure 9:
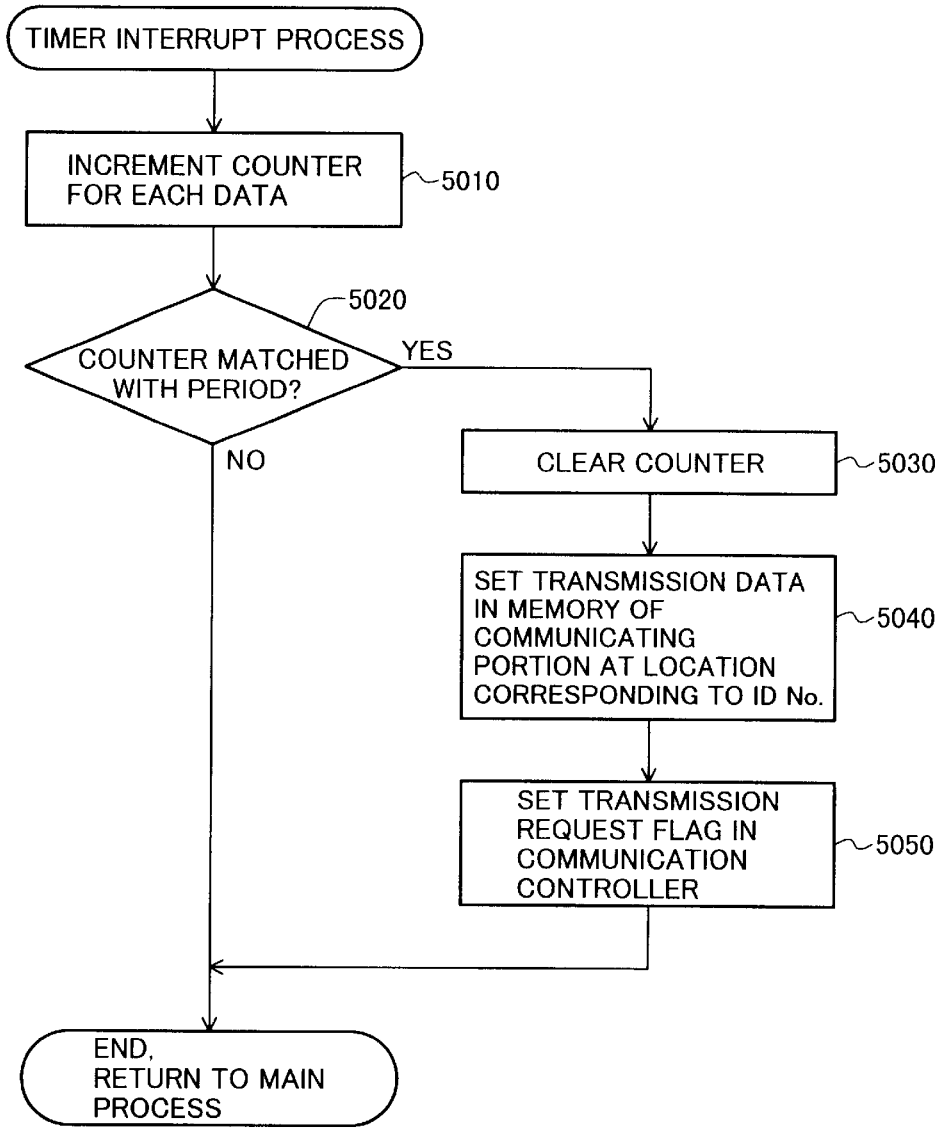
FIG. 9 is a flowchart for explaining a timer interrupt process of a CPU.

A description is first made of a method of transmitting data by taking the control unit 17 as an example. As described above in connection with the table of FIG. 7, each data has to be transmitted at a certain time interval in accordance with the transmission period shown in FIG. 7. The CPU 172 in the control unit 17 generates a timer interrupt in units of a certain time, e.g., per 1 mS, by using a timer (not shown), and interrupts a main process (described later) for starting up a timer interrupt process program represented by a flowchart of FIG. 9. The timer interrupt process will be described below with reference to FIG. 9.

Step 5010:

A counter provided for each item of data is incremented (+1). Stated otherwise, in this STEP, each counter is updated whenever a timer interrupt occurs. For example, when the timer interrupt is executed at intervals of 1 mS, each counter is updated at intervals of 1 mS.

Step 5020:

It is then determined whether a value of each counter is matched with the transmission period of corresponding each item of data shown in FIG. 7. If not matched, the CPU brings the timer interrupt process to an end at once and returns to the main process.

If it is determined in STEP 5020 that the counter value matches with the period, the process flow goes to a branch subsequent to STEP 5030.

Step 5030:

The counter value for data, which has matched with the period, is cleared (to 0).

Step 5040:

The transmission data, for which the counter value has matched with the period, is written in the memory at a storage location corresponding to the ID No.

Step 5050:

A transmission request flag in the communication controller is set for instructing the communicating portion to perform a transmission process.

The CPU brings the timer interrupt process to an end and returns to the main process.

For example, since the target engine revolution speed Nr in the transmission data from the first control unit 17, shown in the table of FIG. 7, has the communication period of 50 mS, the counter value matches with the period and STEP 5030 to 5050 are executed whenever the timer interrupt process is commenced 50 times.

Figure 10:
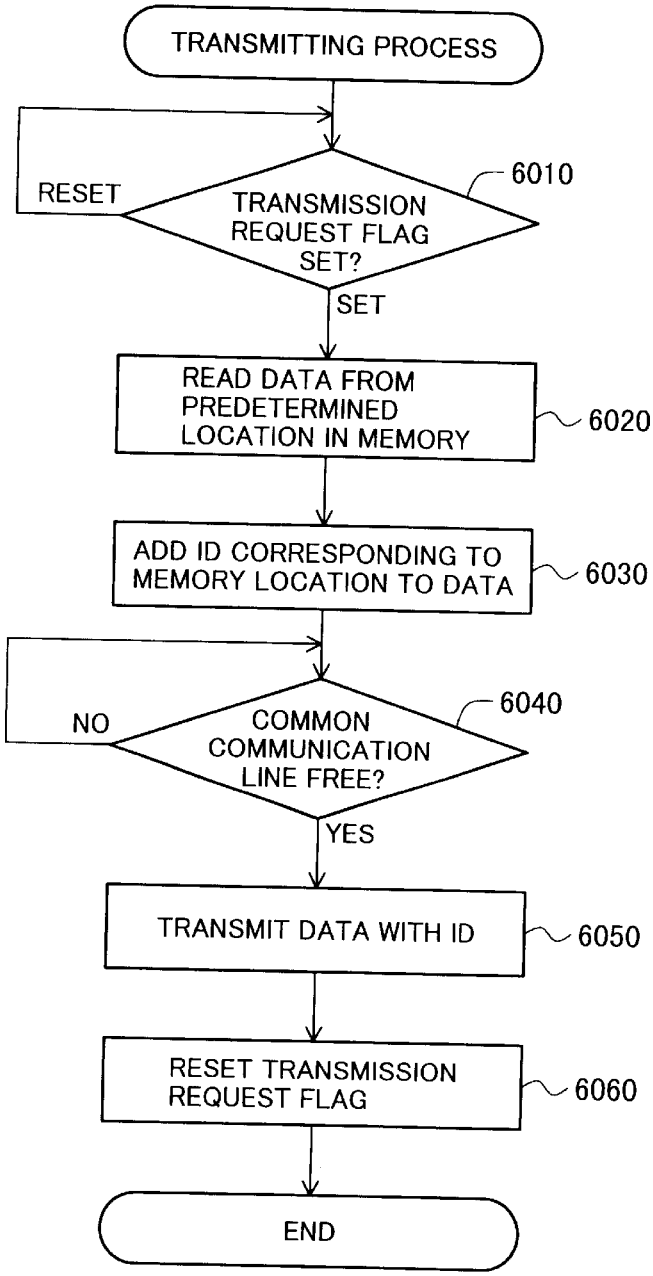
FIG. 10 is a flowchart for explaining a data transmitting process in the communicating portion.

Upon completion of the above-described process by the CPU 172, the communication controller 81 in the first communicating portion 176 executes a process shown in a flowchart of FIG. 10 and transmits control data to the first common communication line 39. The operation of the communication controller 81 in the first communicating portion 176 will be described with reference to FIG. 10.

Step 6010:

It is checked whether the transmission request flag in the communication controller is set. If set, the process flow goes to STEP 6020.

Step 6020:

The controller reads the data at the corresponding storage location in the memory, which has been written there by the CPU.

Step 6030:

An ID corresponding to the storage location is assigned to the read data.

Step 6040:

It is checked whether the common communication line is free. If free, the process flow goes to STEP 6050.

Step 6050:

The data assigned with the ID is converted into time-serial data and transmitted to the common communication line.

STEP 6060:

The transmission request flag in the communication controller is reset so that the controller may receive a next transmission request from the CPU.

Figure 11:
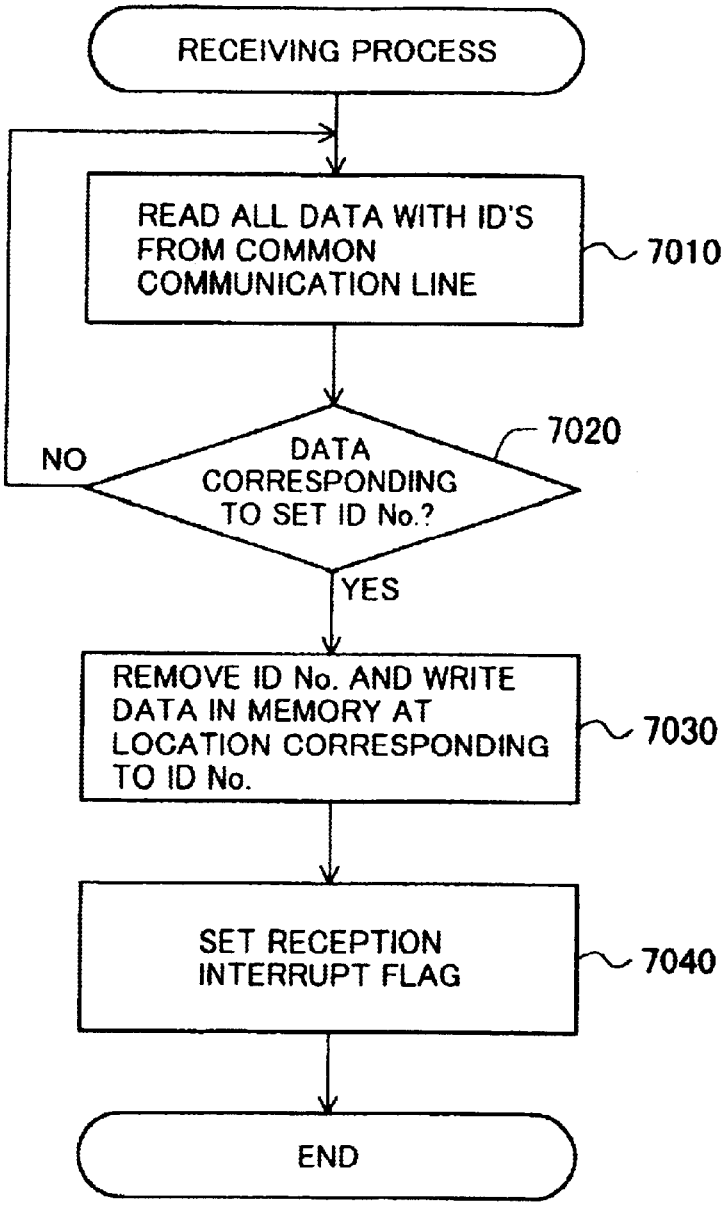
FIG. 11 is a flowchart for explaining a data receiving process in the communicating portion.

Next, a method of receiving data will be described by taking the control unit 23 as an example. A description is first made of the operation of the communicating portion 236 in the control unit 23 with reference to a flowchart shown in FIG. 11.

STEP 7010:

The communication controller reads all data transmitted from the common communication line 39.

STEP 7020:

It is determined whether the ID No. of each read data is matched with the ID No. preset by the CPU 232 in the communication controller of the communicating portion. If matched, the process flow goes to STEP 7030. If not matched, the communication controller returns to STEP 7010 and reads next transmission data.

STEP 7030:

The ID No. is removed from the data, of which ID No. has matched, and the data is written in the memory 80 at a storage location corresponding to the ID No.

Step 7040:

A reception interrupt flag in the communication controller is set to inform the CPU 232 of the fact that the reception has been completed, and issues the reception interrupt signal to the CPU 232.

Upon receiving the reception interrupt signal from the communicating portion 236, the CPU 232 interrupts the main process (described later) and executes the reception interrupt process.

Figure 12:
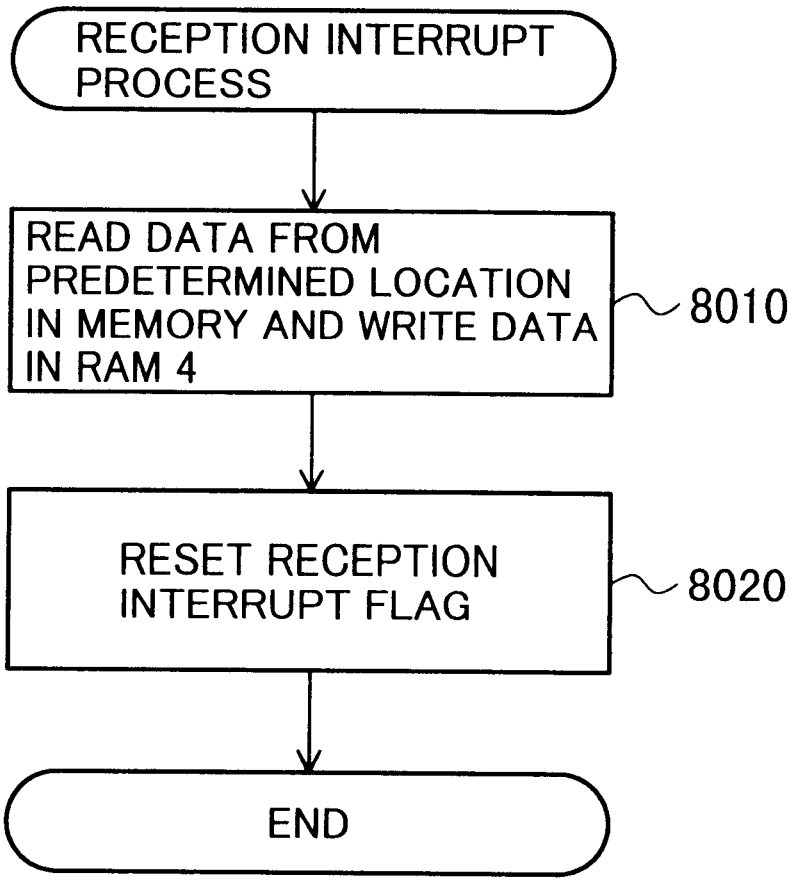
FIG. 12 is a flowchart for explaining a reception interrupt process of the CPU.

The reception interrupt process will be described with reference to a flowchart of FIG. 12.

Step 8010:

The CPU reads the data out of the memory 80 in the communicating portion 236 at the predetermined storage location corresponding to the ID No., and writes the read data in the RAM 234.

Step 8020:

The reception interrupt flag in the communication controller 81 is reset.

Thus, for example, the target engine revolution speed Nr transmitted from the control unit 17 at intervals of 50 mS is received by the control unit 23 at the same period as the data transmission period.

While the foregoing description has been made of the processing and operation executed by the CPUs 172, 232 and the first communicating portions 176, 236 in the control units 17, 23 for transmitting and receiving data via the first common communication line 39, the second communicating portion 177 in the control unit 17 and the first and second communicating portions in the other control units and monitor units also transmit and receive data via the first and second common communication lines 39, 40 through the similar processing and operation.

Next, the main process in each of the control units and the monitor units will be described.

Figure 13:
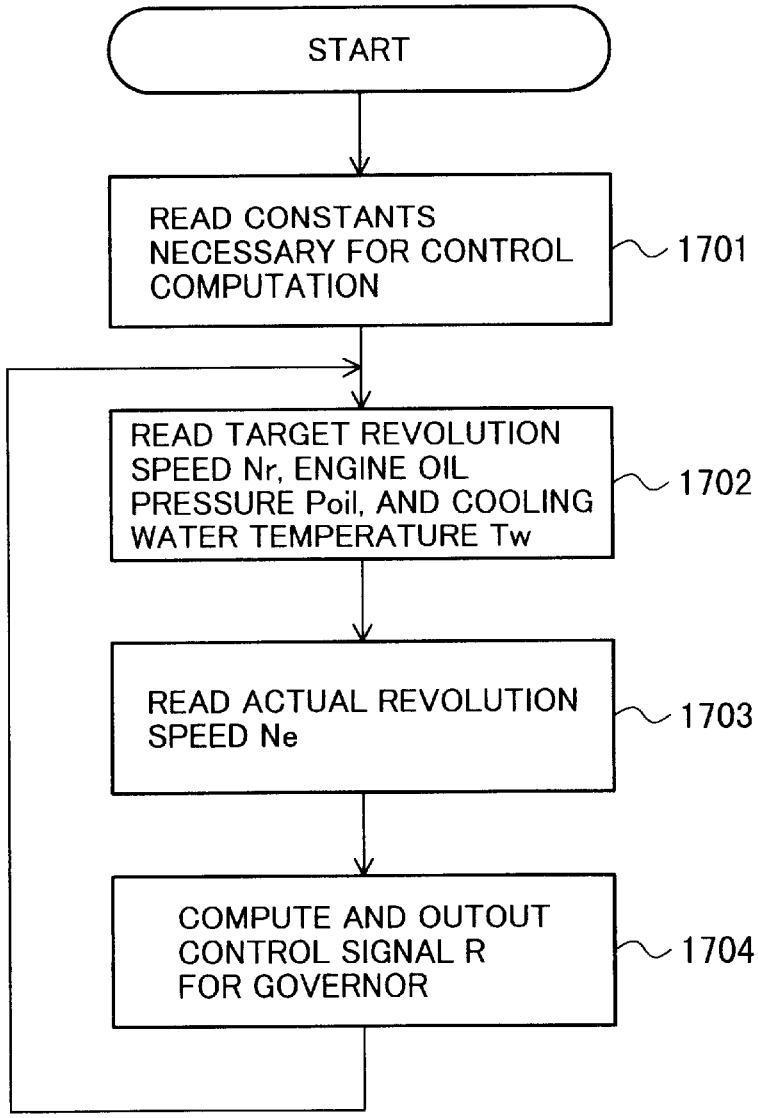
FIG. 13 is a flowchart for explaining a main process of the first control unit.

A description is first made of the main process of the control unit 17 with reference to FIG. 13.

A control program represented by a flowchart of FIG. 13 is stored in the ROM 173 of the control unit 17. Upon power-on, the CPU starts up the control program in the ROM 173 and executes the main process as follows.

Step 1701:

The CPU reads, from the ROM 173, constants necessary for control computation.

Step 1702:

The CPU reads, through the A/D converter, the target revolution speed Nr from the target revolution-speed setting unit 16, the engine oil pressure Poil and the cooling water temperature Tw.

Step 1703:

The CPU receives, through the counter 175, the actual revolution speed Ne of the prime mover 14 from the governor 15.

Step 1704:

The control signal R is outputted to the governor 15 so that the actual revolution speed Ne is matched with the target engine revolution speed Nr, whereby the revolution speed of the prime mover 14 is controlled.

The CPU returns to STEP 1702 and repeats the above-described process.

Figure 14:
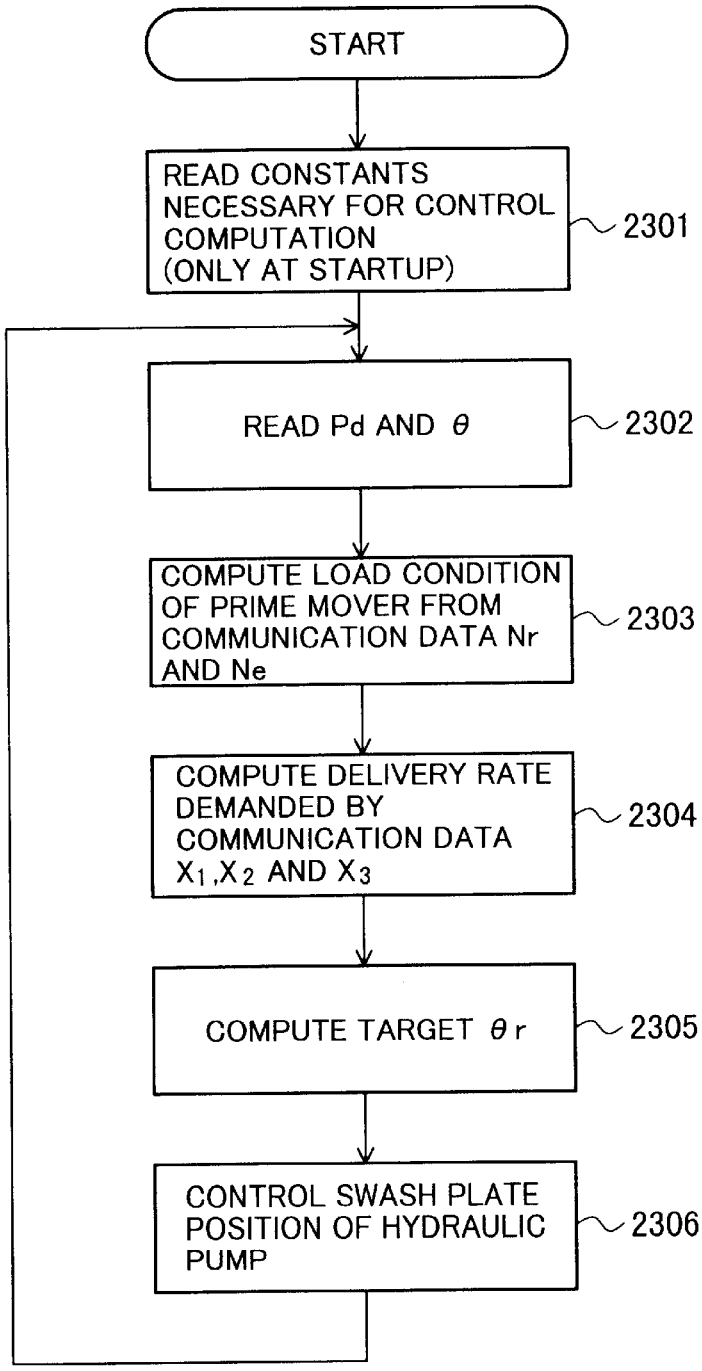
FIG. 14 is a flowchart for explaining a main process of the second control unit.

A description is now made of the main process of the control unit 23 with reference to FIG. 14.

A control program represented by a flowchart of FIG. 14 is stored in the ROM 233 of the control unit 23. Upon power-on, the CPU starts up the control program in the ROM 233 and executes the main process as follows.

Step 2301:

The CPU reads, from the ROM 233, constants necessary for control computation.

Step 2302:

The CPU reads, through the A/D converter, the pressure signal Pd from the pressure sensor 22 and the swash plate position signal θ from the swash plate position sensor 21.

Step 2303:

The load condition of the prime mover 14 is computed using the communication data Nr, Ne from the control unit 17.

Step 2304:

The hydraulic fluid delivery rate demanded for the hydraulic pump 18 is computed based on the communication data X1, X2 and X3 from the control unit 33.

Step 2305:

The delivery rate allowable for the hydraulic pump is computed from the load condition of the prime mover and Pd based on the hydraulic fluid delivery rate demanded for the hydraulic pump, which has been computed in the preceding step, and the target tilting angle θr is calculated from the allowable delivery rate.

Step 2306:

The CPU outputs a control signal to the delivery rate adjusting portion 20 so that the swash plate position signal θ is matched with the target tilting angle θr, thereby controlling the tilting position of the swash plate 19 of the hydraulic pump 18.

The CPU returns to STEP 2302 and repeats the above-described process.

Figure 15:
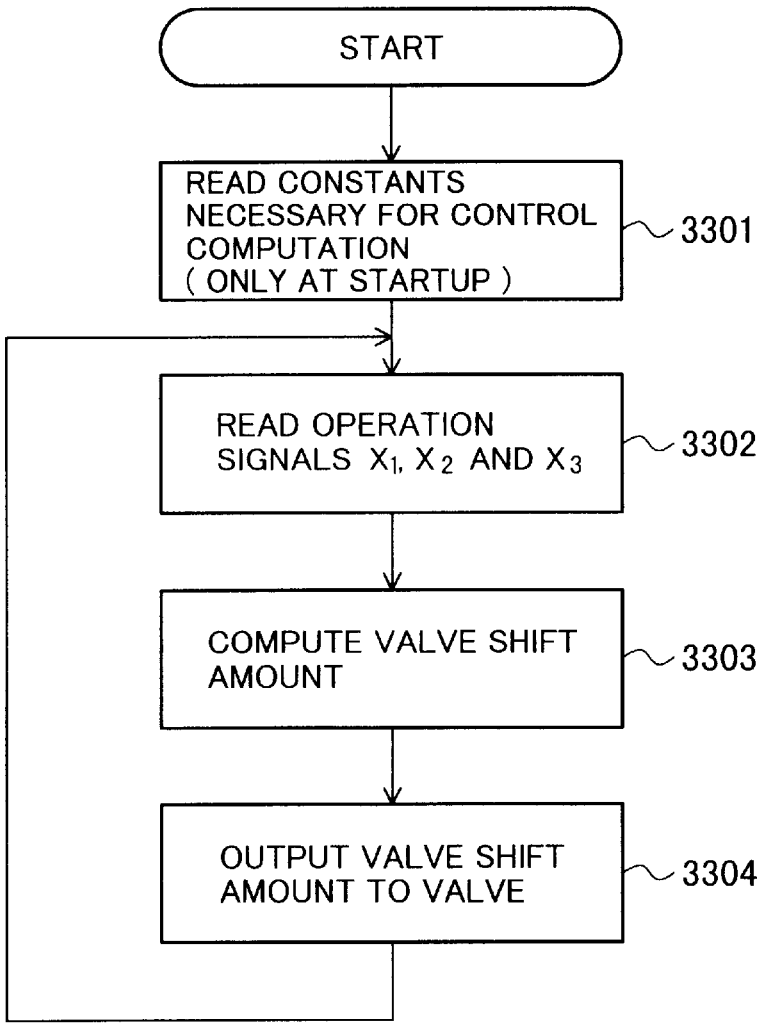
FIG. 15 is a flowchart for explaining a main process of the third control unit.

A description is now made of the main process of the control unit 33 with reference to FIG. 15.

A control program represented by a flowchart of FIG. 15 is stored in the ROM 333 of the control unit 33. Upon power-on, the CPU starts up the control program in the ROM 333 and executes the main process as follows.

Step 3301:

The CPU reads, from the ROM 333, constants necessary for control computation.

Step 3302:

The CPU reads, through the A/D converter 331, the operation signals X1, X2 and X3 from the electrical levers 27, 28 and 29.

Step 3303:

Respective valve shift amounts corresponding to the operation signals X1, X2 and X3 are computed.

Step 3304:

The CPU outputs, through the D/A converter 337 and the amplifiers 3390–3395, operation commands to the proportional solenoid valves 24R–26L for driving the control valves, and thereafter returns to STEP 3302.

Figure 16:
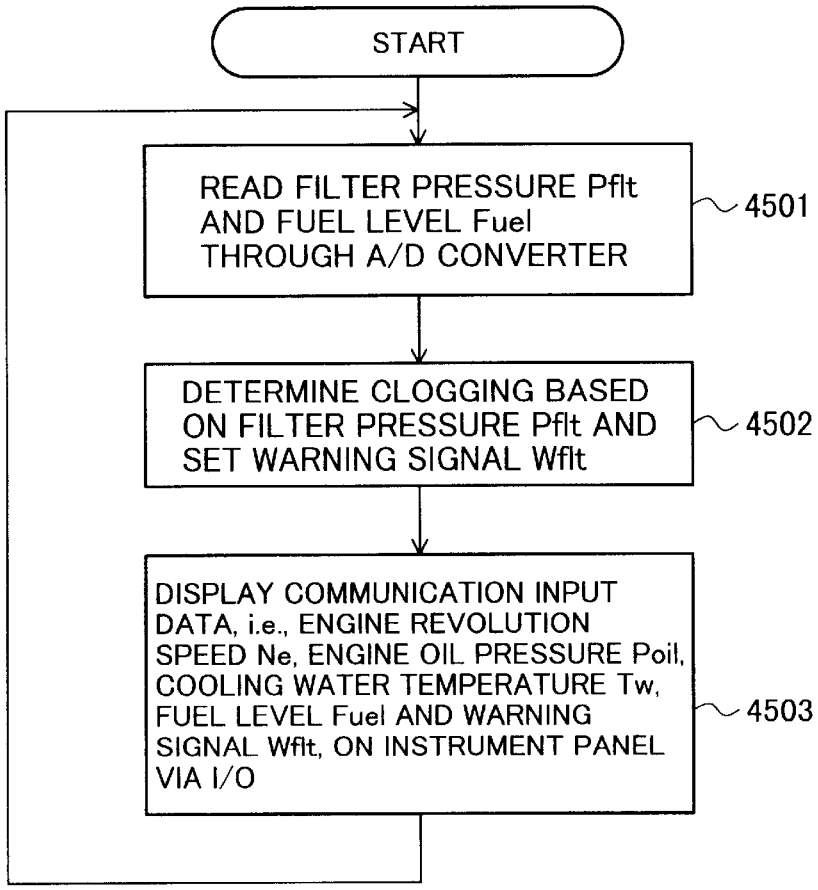
FIG. 16 is a flowchart for explaining a main process of the first monitor unit.

A description is now made of the main process of the first monitor unit 45 with reference to FIG. 16.

A control program represented by a flowchart of FIG. 16 is stored in the ROM 453 of the first monitor unit 45. Upon power-on, the CPU starts up the control program in the ROM 453 and executes the main process as follows.

Step 4501:

The CPU receives, through the A/D converter 451, the filter pressure Pflt and the fuel level Fuel.

Step 4502:

Whether clogging occurs or not is determined from the filter pressure, and a warning signal Wflt is set.

Step 4503:

The CPU displays, on the instrument panel, the engine revolution speed Ne, the engine oil pressure Poil, the cooling water temperature Tw, the fuel level Fuel, and the warning signal Wflt, which have been received through communication via the I/O 458.

The CPU returns to STEP 4501.

A description is now made of the main process of the second monitor unit 46 with reference to FIGS. 17 to 25.

Figure 17:
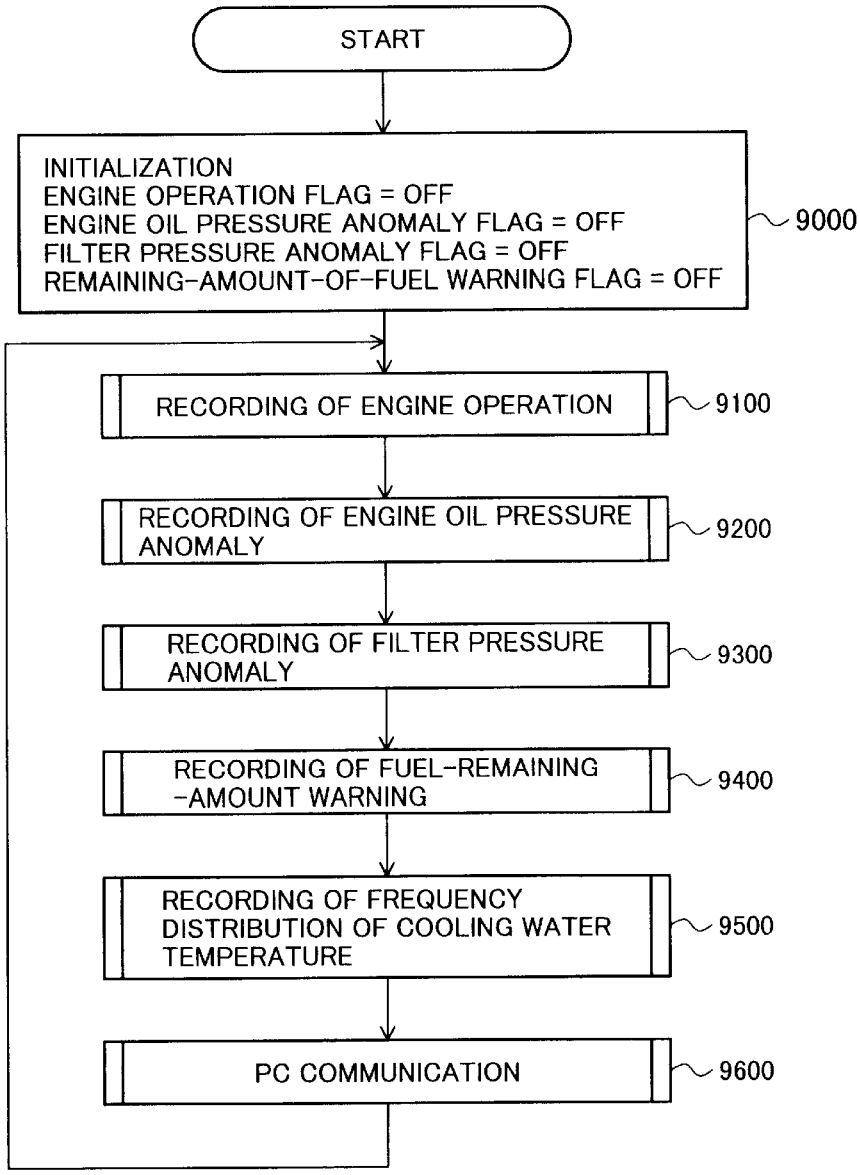
FIG. 17 is a flowchart for explaining a main process of the second monitor unit.

FIG. 17 shows the whole of a control program stored in the ROM 463 of the second monitor unit 46.

When the control program is started up upon power-on of the monitor unit 46, the CPU executes initialization in Block 9000. With the initialization, an engine operation flag, an engine oil pressure anomaly flag, a filter pressure anomaly flag, and a fuel-remaining-amount warning flag, which are used in subsequent Blocks 9100–9400, are each set to an off-state.

Figure 18:
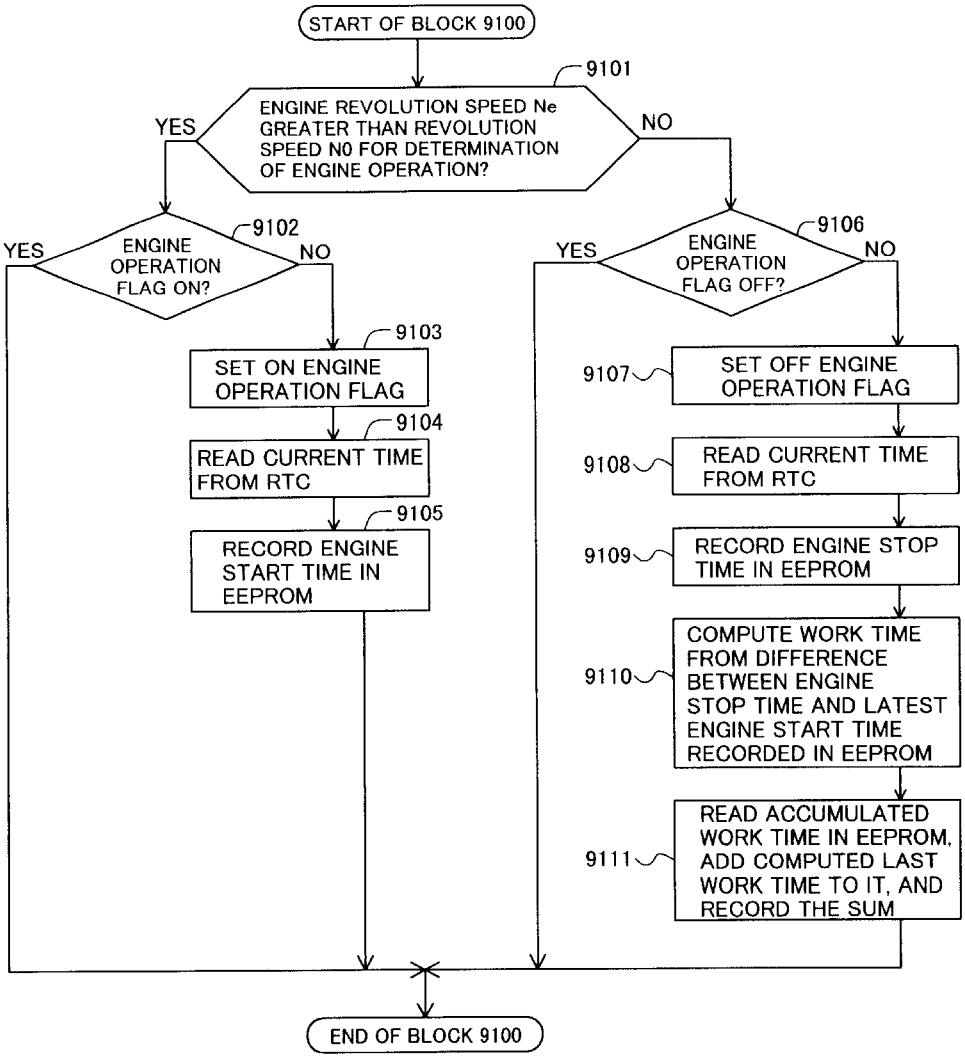
FIG. 18 is a flowchart for explaining details of an engine operation recording process contained in the main process of the second monitor unit.

Then, the CPU executes an engine operation recording process in Block 9100. FIG. 18 shows details of the engine operation recording process. The process in Block 9100 will be described below with reference to FIG. 18.

Step 9101:

It is first determined whether the engine revolution speed Ne, which has been received by the above-described communication manner via the common communication line, is greater than a revolution speed N0 for determining the engine operation. If Ne is greater than N0, the process flow goes to STEP 9102. If Ne is smaller than N0, the process flow goes to STEP 9106. Herein, the revolution speed N0 for determining the engine operation is set to, e.g., a value slightly lower than the idling revolution speed of the engine.

Step 9102:

If the engine revolution speed Ne is greater than the revolution speed N0 for determining the engine operation, it is determined whether the engine operation flag, which indicates whether the engine was under operation in the last cycle of this process, is set on (the on-state means that the engine was under operation). If the engine operation flag is set on, this means that the condition is the same as that in the last process cycle, and hence the CPU brings the process in Block 9100 into an end. If it is set off, the process flow goes to STEP 9103. In the initial state, since the engine operation flag is set off, the process flow always goes to STEP 9103.

Step 9103:

The engine operation flag is set on to indicate that the engine has started the operation.

Step 9104:

The current time-of-day is read from the RTC 4603.

Step 9105:

The engine start time is recorded in the EEPROM 4602. In the EEPROM, the engine start time is recorded in the form of, e.g., "year, month, day, time, START" as indicated by record of the engine operation shown in FIG. 19. The CPU then brings the process in Block 9100 into an end.

Step 9106:

On the other hand, if it is determined in STEP 9101 that the engine revolution speed Ne is smaller than the revolution speed NO for determining the engine operation, the CPU executes STEP 9106. In STEP 9106, it is determined whether the engine operation flag is set off. If the engine operation flag is set off, this means that the condition is the same as that in the last process cycle, and hence the CPU brings the process in Block 9100 into an end. If it is set on, the process flow goes to STEP 9107.

Step 9107:

The engine operation flag is set off to indicate that the engine has stopped the operation.

Step 9108:

The current time-of-day is read from the RTC 4603.

Step 9109:

The engine stop time is recorded in the EEPROM 4602. In the EEPROM, similarly to the above-mentioned case, the engine stop time is recorded in the form of, e.g., "year, month, day, time, STOP" as indicated by record of the engine operation shown in FIG. 19.

Step 9110:

Then, the CPU reads the latest engine start time stored as a part of the record of the engine operation in the EEPROM 4602, and computes a work time from the difference between the read engine start time and the current engine stop time. In an example shown in FIG. 19, since the latest engine start time is "2000.1.28 AM 09:10" and the current engine stop time is "200.1.28 PM 04:30", the difference therebetween is 7 hours and 20 minutes. This period of time represents the work time during which the engine has been operated.

Figure 20:
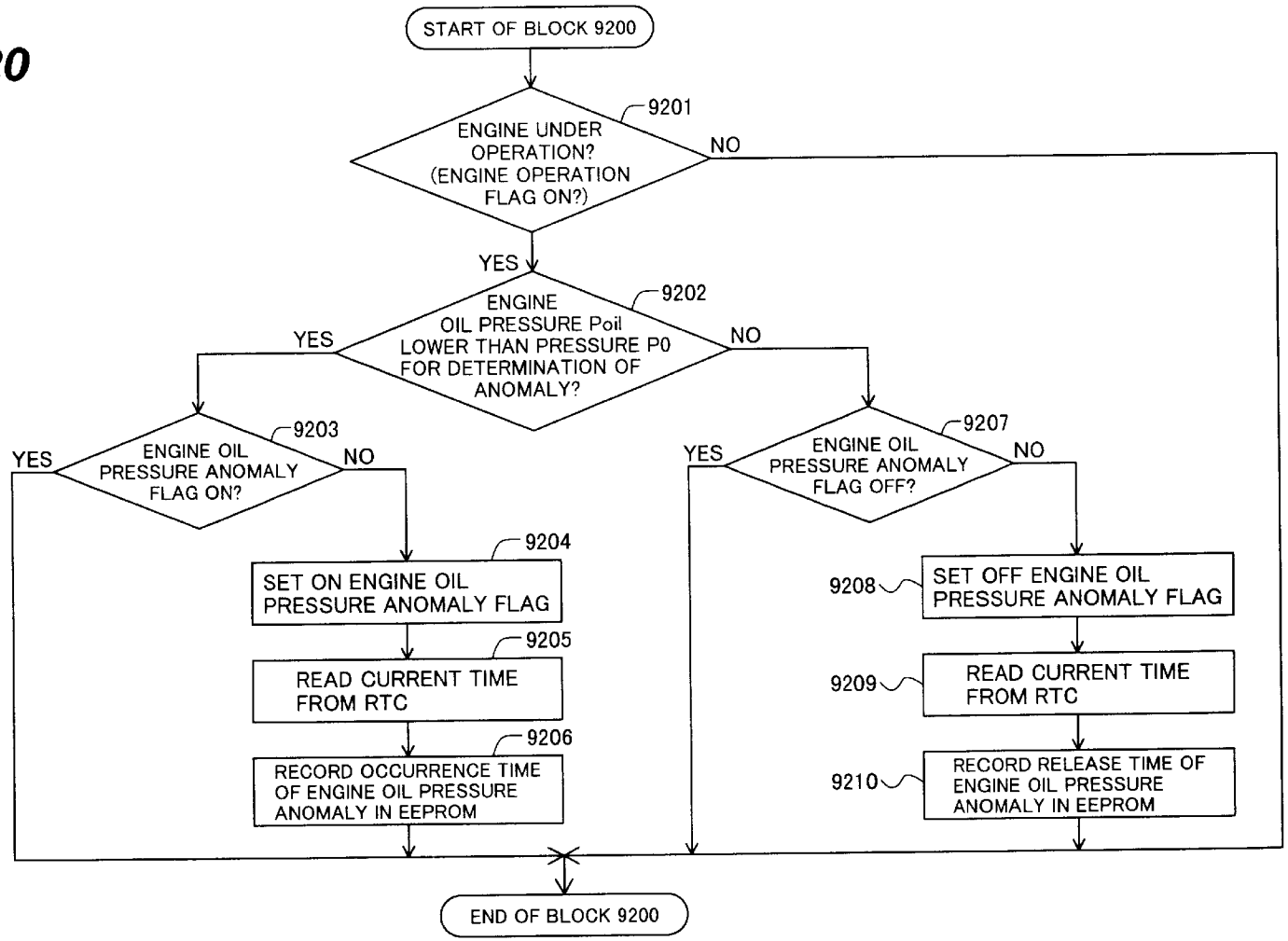
FIG. 20 is a flowchart for explaining details of an engine oil-pressure anomaly recording process contained in the main process of the second monitor unit.

Step 9111:

Subsequently, the CPU reads the accumulated engine work time stored in the EEPROM 4602, adds the work time computed in STEP 9110 to it, and stores again the sum in the EEPROM 4602 as the accumulated engine work time. The CPU then brings the process in Block 9100 into an end After completion of the process in Block 9100, the CPU executes a process in Block 9200. A flowchart of FIG. 20 shows details of the process in Block 9200. The process in Block 9200 will be described below with reference to FIG. 20.

Step 9201:

It is first determined whether the engine is under operation, by checking whether the engine operation flag is set on. If the engine is not under operation (i.e., if the engine operation flag is set off), the CPU brings the process in Block 9200 into an end. If the engine is under operation, the process flow goes to STEP 9202.

Step 9202:

It is then determined whether the engine oil pressure Poil, which has been received via the common communication line, is lower than an anomaly determination pressure P0. If Poil is lower than P0, this is determined as indicating the occurrence of anomaly, and the process flow goes to STEP 9203. If the engine oil pressure Poil is higher than the anomaly determination pressure P0, this is determined as indicating the normal state, and the process flow goes to STEP 9207.

Step 9203:

If the occurrence of anomaly is determined in STEP 9202, it is determined whether the engine oil pressure anomaly flag is set on at that time. If set on, this indicates that the abnormal state is continued, and therefore the CPU brings the process in Block 9200 into an end at once. If the engine oil pressure anomaly flag is determined as being not on but off, the process flow goes to STEP 9204.

Step 9204:

The engine oil pressure anomaly flag is set on.

Step 9205:

The current time-of-day is read from the RTC 4603.

Step 9206:

The occurrence time of engine oil pressure anomaly is recorded in the EEPROM 4602 at a storage location, which is specific to the engine oil pressure anomaly, in the form of a "year, month, day, hour, minute, ON" as shown in FIG. 19. The CPU then brings the process in Block 9200 into an end.

When the second monitor unit 46 has started up the operation, the engine oil pressure anomaly flag is set off in the initialization 9000. Accordingly, at the time when first engine oil pressure anomaly occurs after the startup, the processing of STEP 9202-9203-9204-9205-9206 is executed and the engine oil pressure anomaly flag is set on.

Step 9207:

On the other hand, if it is determined in STEP 9202 that there is no anomaly in the engine oil pressure (Poil≧P0), the CPU determines whether the engine oil pressure anomaly flag is set off. If set off, this means that the normal state of the engine oil pressure is continued, and therefore the CPU brings the process in Block 9200 into an end at once. If the engine oil pressure anomaly flag is not set off, i.e., if engine oil pressure anomaly has occurred until the last process cycle, the process flow goes to STEP 9208.

Step 9208:

The engine oil pressure anomaly flag is set off.

Step 9209:

The current time-of-day is read from the RTC 4603.

Step 9210:

The release time of engine oil pressure anomaly is recorded in the EEPROM 4602 at a storage location, which is specific to the engine oil pressure anomaly, in the form of "year, month, day, hour, minute, OFF" as shown in FIG. 19. The CPU then brings the process in Block 9200 into an end.

As described above, whenever engine oil pressure anomaly occurs or is released, the occurrence or release time of engine oil pressure anomaly is recorded in the EEPROM 4602 successively as shown in FIG. 19.

Figure 21:
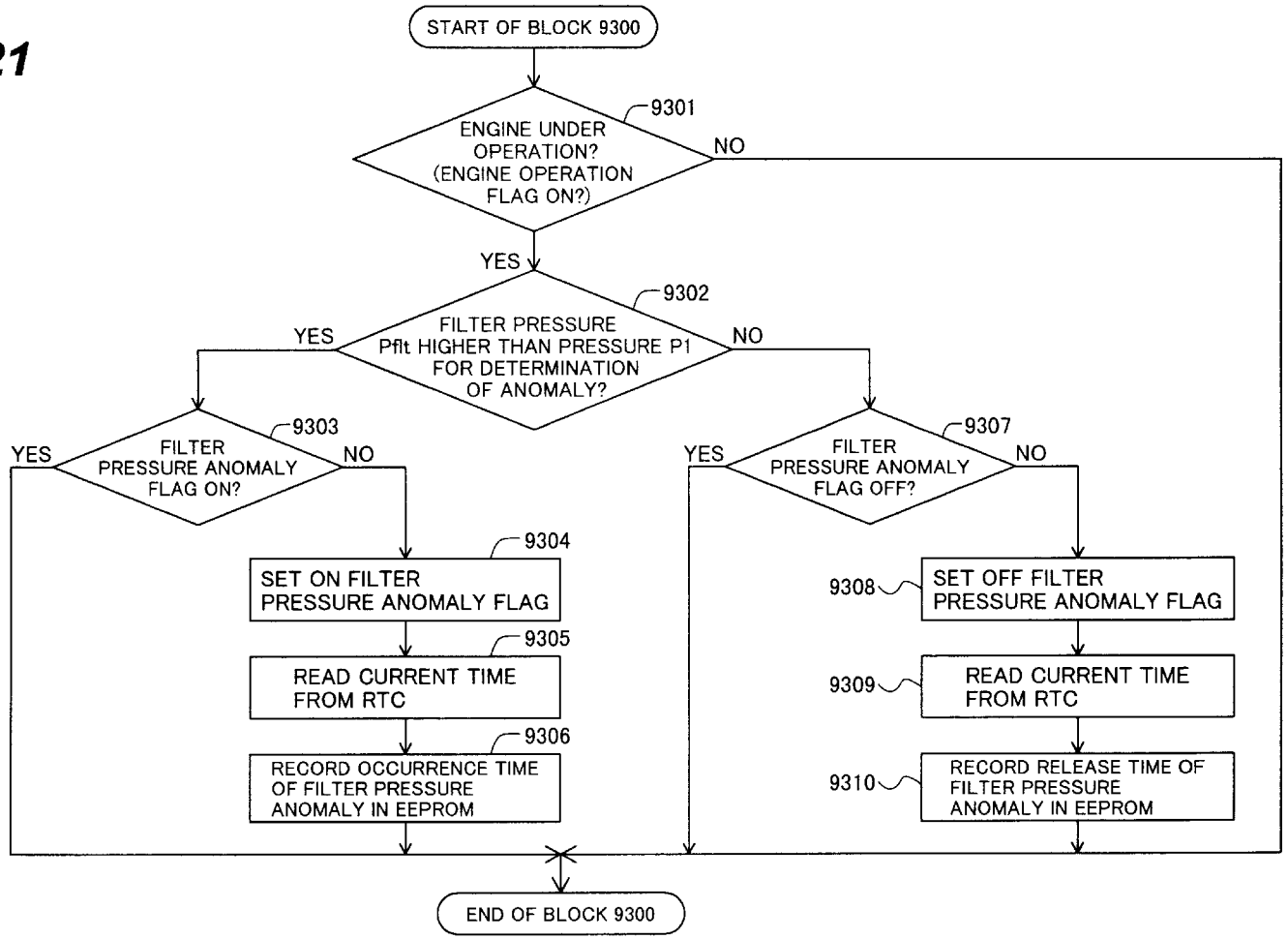
FIG. 21 is a flowchart for explaining details of an filter pressure anomaly recording process contained in the main process of the second monitor unit.

After completion of the process in Block 9200, the CPU executes a process in Block 9300. A flowchart of FIG. 21 shows details of the process in Block 9300. The process in Block 9300 will be described below with reference to FIG. 21.

Step 9301:

It is first determined whether the engine is under operation, by checking whether the engine operation flag is set on. If the engine is not under operation (i.e., if the engine operation flag is set off), the CPU brings the process in Block 9300 into an end. If the engine is under operation, the process flow goes to STEP 9302.

Step 9302:

It is then determined whether the filter pressure Pflt, which has been received via the common communication line, is higher than an anomaly determination pressure P1. If Pflt is higher than P1, this is determined as indicating the occurrence of anomaly, and the process flow goes to STEP 9303. If the filter pressure Pflt is lower than the anomaly determination pressure P1, this is determined as indicating the normal state, and the process flow goes to STEP 9307.

Step 9303:

If the occurrence of anomaly is determined in STEP 9302, it is determined whether the filter oil pressure anomaly flag is set on at that time. If set on, this indicates that the abnormal state is continued, and therefore the CPU brings the process in Block 9300 into an end at once. If the filter pressure anomaly flag is determined as being not on but off, the process flow goes to STEP 9304.

Step 9304:

The filter pressure anomaly flag is set on.

Step 9305:

The current time-of-day is read from the RTC 4603.

Step 9306:

The occurrence time of filter pressure anomaly is recorded in the EEPROM 4602 at a storage location, which is specific to the filter pressure anomaly, in the form of "year, month, day, hour, minute, ON" as shown in FIG. 19. The CPU then brings the process in Block 9300 into an end.

When the second monitor unit 46 has started up the operation, the filter pressure anomaly flag is set off in the initialization 9000. Accordingly, at the time when first filter pressure anomaly occurs after the startup, the processing of STEP 9302-9303-9304-9305-9306 is executed and the filter pressure anomaly flag is set on.

Step 9307:

On the other hand, if it is determined in STEP 9302 that there is no anomaly in the filter pressure (Pflt<P1), the CPU determines whether the filter pressure anomaly flag is set off. If set off, this means that the normal state of the engine oil pressure is continued, and therefore the CPU brings the process in Block 9300 into an end at once. If the filter pressure anomaly flag is not set off, i.e., if engine oil pressure anomaly has occurred until the last process cycle, the process flow goes to STEP 9308.

Step 9308:

The filter pressure anomaly flag is set off.

Step 9309:

The current time-of-day is read from the RTC 4603.

Step 9310:

The release time of filter pressure anomaly is recorded in the EEPROM 4602 at a storage location, which is specific to the filter pressure anomaly, in the form of "year, month, day, hour, minute, OFF" as shown in FIG. 19. The CPU then brings the process in Block 9300 into an end.

As described above, whenever filter pressure anomaly occurs or is released, the occurrence or release time of filter pressure anomaly is recorded in the EEPROM 4602 successively as shown in FIG. 19.

Figure 22:
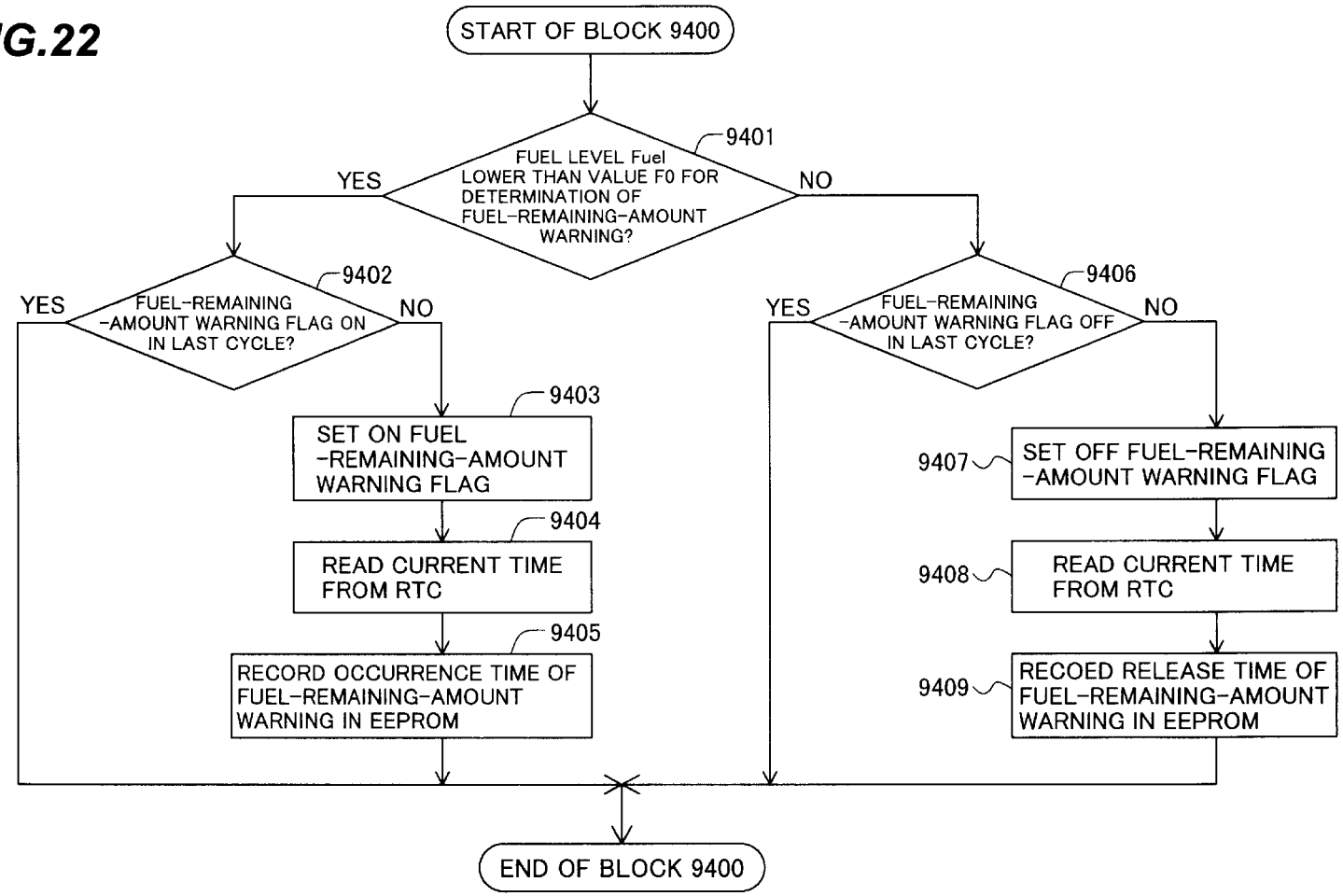
FIG. 22 is a flowchart for explaining details of a fuel-remaining-amount warning recording process contained in the main process of the second monitor unit.

After completion of the process in Block 9300, the CPU executes a process in Block 9400. A flowchart of FIG. 22 shows details of the process in Block 9400. The process in Block 9400 will be described below with reference to FIG. 22.

Step 9401:

It is determined whether the fuel level Fuel, which has been received via the common communication line, is lower than an anomaly determination value F0. If Fuel is lower than F0, this is determined as indicating that the remaining amount of fuel is in the warning state (fuel shortage), and the process flow goes to STEP 9402. If the fuel level Fuel is higher than the anomaly determination value F0, this is determined as indicating the normal state, and the process flow goes to STEP 9406.

Step 9402:

If the warning state (fuel shortage) is determined in STEP 9401, it is determined whether the fuel-remaining-amount warning flag is set on at that time. If set on, this indicates that the warning state is continued, and therefore the CPU brings the process in Block 9400 into an end at once. If the fuel-remaining-amount warning flag is determined as being not on but off, the process flow goes to STEP 9403.

Step 9403:

The fuel-remaining-amount warning flag is set on.

Step 9404:

The current time-of-day is read from the RTC 4603.

Step 9405:

The occurrence time of fuel-remaining-amount warning is recorded in the EEPROM 4602 at a storage location, which is specific to the fuel-remaining-amount warning, in the form of "year, month, day, hour, minute, ON" as shown in FIG. 19. The CPU then brings the process in Block 9400 into an end.

When the second monitor unit 46 has started up the operation, the fuel-remaining-amount warning flag is set off in the initialization 9000. Accordingly, at the time when first fuel-remaining-amount warning occurs after the startup, the processing of STEP 9401-9402-9403-9404-9405 is executed and the fuel-remaining-amount warning flag is set on.

Step 9406:

On the other hand, if it is determined in STEP 9401 that the remaining amount of fuel is not deficient (Fuel>F0), the CPU determines whether the fuel-remaining-amount warning flag is set off. If set off, this means that the normal state of the remaining amount of fuel is continued, and therefore the CPU brings the process in Block 9400 into an end at once. If the fuel-remaining-amount warning flag is not set off, i.e., if fuel-remaining-amount warning has occurred until the last process cycle, the process flow goes to STEP 9407.

Step 9407:

The fuel-remaining-amount warning flag is set off.

Step 9408:

The current time-of-day is read from the RTC 4603.

Step 9409:

The release time of fuel-remaining-amount warning is recorded in the EEPROM 4601 at a storage location, which is specific to the fuel-remaining-amount warning, in the form of "year, month, day, hour, minute, OFF" as shown in FIG. 19. The CPU then brings the process in Block 9400 into an end.

As described above, whenever fuel-remaining-amount warning occurs or is released, the occurrence or release time of fuel-remaining-amount warning is recorded in the EEPROM 4602 successively as shown in FIG. 19.

Figure 23:
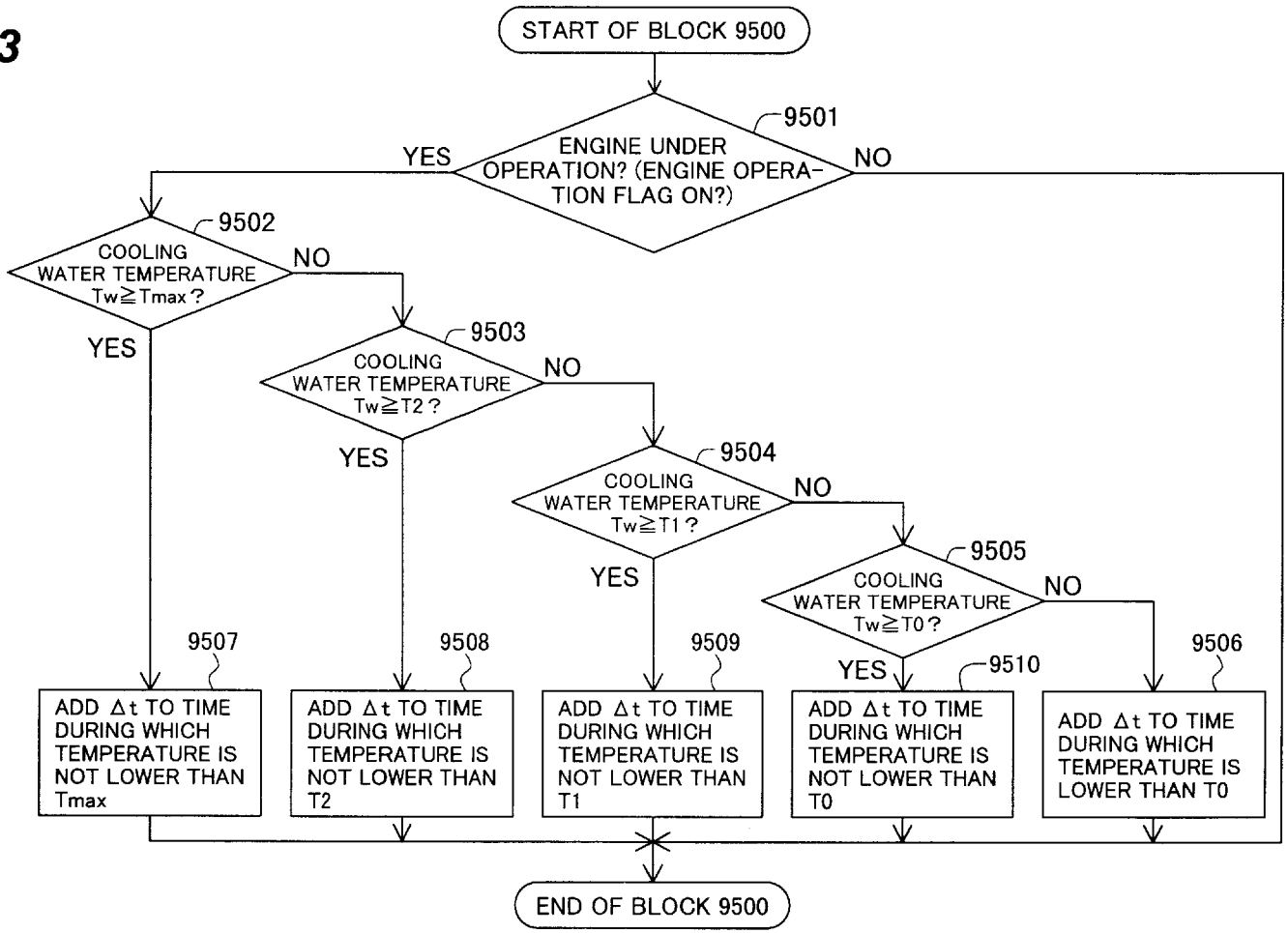
FIG. 23 is a flowchart for explaining details of a cooling-water temperature frequency distribution recording process contained in the main process of the second monitor unit.

After completion of the process in Block 9400, the CPU executes a process in Block 9500. A flowchart of FIG. 23 shows details of the process in Block 9500. The process in Block 9500 will be described below with reference to FIG. 23.

Step 9501:

It is first determined whether the engine is under operation, by checking whether the engine operation flag is set on. If the engine is not under operation (i.e., if the engine operation flag is set off), the CPU brings the process in Block 9500 into an end. If the engine is under operation, the process flow goes to STEP 9502.

STEP 9502–9505:

In these steps, the CPU determines in which one of the following five areas the cooling water temperature Tw received via the common communication line falls:

(1) Tw≧Tmax
(2) Tmax>Tw≧T2
(3) T2>Tw≧T1
(4) T1>Tw≧T0
(5) T0>Tw Depending on a determination result, the process flow goes to a next step in accordance with one of the following five cases:

(1) Tw≧Tmax . . . to STEP 9507
(2) Tmax≧>Tw≧T2 . . . to STEP 9508
(3) T2>Tw≧T1 . . . to STEP 9509
(4) T1>Tw≧T0 . . . to STEP 9510
(5) T0>Tw . . . to STEP 9506

Step 9506–9510:

In these steps, a period of time Δt (in unit of, e.g., mS) required for processing of Blocks 9100–9600 by the monitor unit 46 is added to values in respective storage locations as indicated by water temperature frequency distribution in FIG. 19. For example, if it is determined in STEP 9502 that the cooling water temperature Tw is not lower than Tmax, the process flow goes to STEP 9507. Then, in STEP 9507, Δt is added to the time recorded in the EEPROM 4602 at a storage location specific to Tw≧Tmax in the water temperature frequency distribution.

As the above-described processing is repeated, the time corresponding to each range of the cooling water temperature is accumulated in the specific storage location for the water temperature frequency distribution, and frequency distribution of the cooling water temperature is recorded in terms of time as shown in FIG. 19. In the example of FIG. 19, the following frequency distribution of the cooling water temperature is obtained:

(1) Tw≧Tmax . . . 10 hr
(2) Tmax>Tw≧T2 . . . 190 hr
(3) T2>Tw≧T1 . . . 310 hr
(4) T1>Tw≧T0 . . . 520 hr
(5) T0>Tw . . . 220 hr It is hence understood that, of the accumulated engine work time of 1250 hr, 520 hr corresponds to the range of T1>Tw >T0.

The determination values Tmax, T2, T1 and T0 used in this embodiment may be set for each model of the machine body. For example, the determination values can be set such that Tmax is the overheat temperature in design, T0 is the freezing temperature 0° C., and the other values are decided by dividing the range of Tmax to T0 into equal three zones.

Then, the CPU brings the process in Block 9500 into an end.

After completion of the process in Block 9500, the process flow goes to Block 9600. Block 9600 represents a process in which the personal computer (PC) 53 is connected to the monitor unit 46 and each item of information stored in the EEPROM 4602 is outputted. The PC 53 is not always connected, but when a service personnel performs maintenance of the machine body, the PC 53 is connected to a terminal of the communicating portion 4601 in the monitor unit 46 for outputting of the information.

Figure 24:
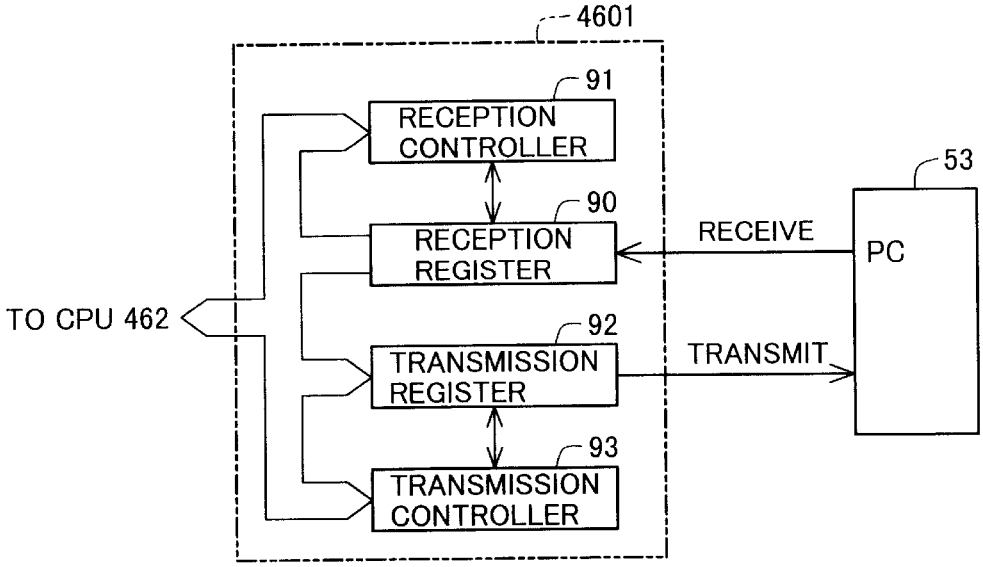
FIG. 24 is a block diagram showing a configuration of a third communicating portion.
Figure 25:
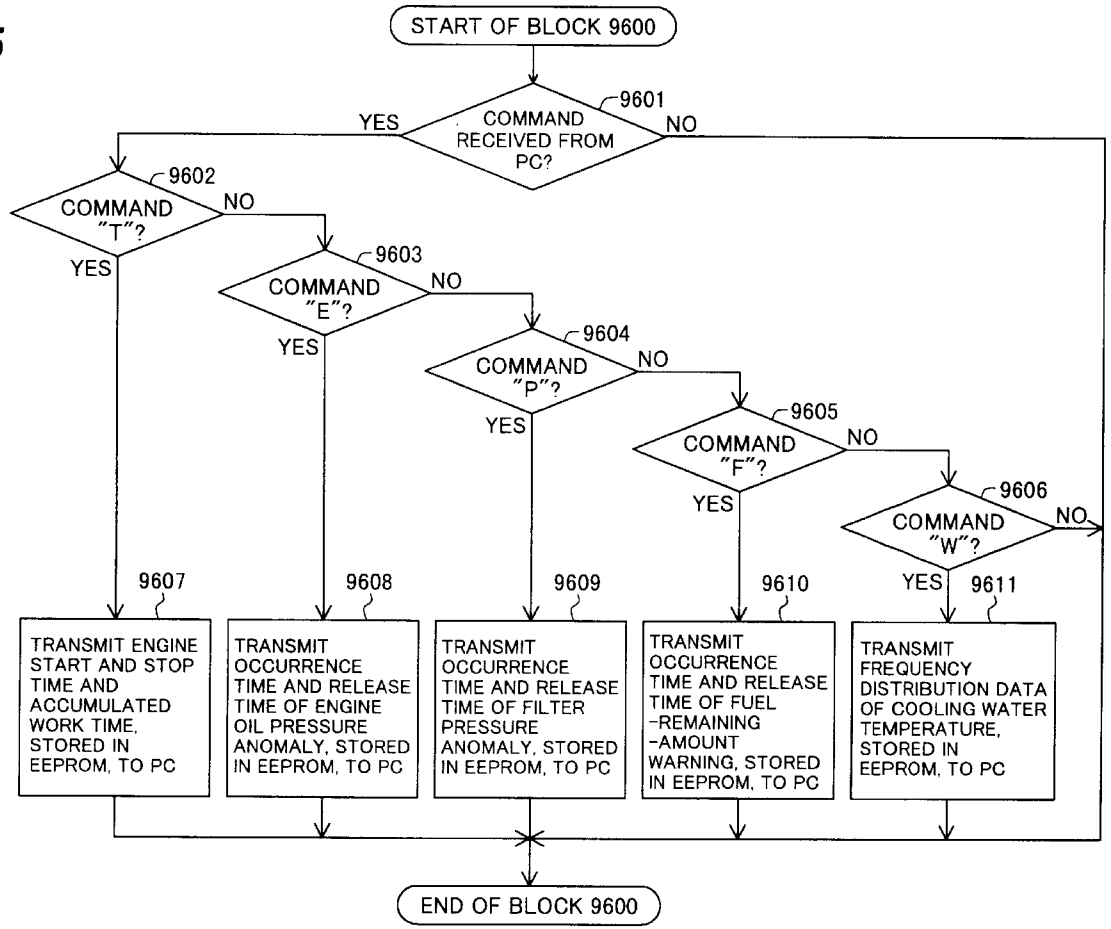
FIG. 25 is a flowchart for explaining details of a PC communicating process contained in the main process of the second monitor unit.

An internal configuration of the third communicating portion 4601 in the second monitor unit 46 is shown FIG. 24. Upon receiving data in the form of a serial signal from the PC 53, the third communicating portion 4601 converts the received data into digital data and stores it in a reception register 90. When the data is inputted to the reception register 90, a reception completion flag in a reception controller 91 is set. By monitoring the reception completion flag, the CPU is able to know inputting of the data. Also, when transmitting data from the CPU, the CPU checks whether a transmission flag used for indicating the free state of a transmission register in a transmission controller 93 indicates the free state (i.e., whether it is set). If it is confirmed that the transmission flag is set, the CPU is allowed to write digital transmission data in the transmission register 92. Upon data being written in the transmission register 92, the third communicating portion 4601 automatically converts the written digital data into serial data and transmits the converted data to the PC. The data is in the form of character code, for example. Thus, instructions (commands), numerical values and so on are transmitted and received in the form of character code.

The communication to the PC is executed using the above-described functions of the third communicating portion 4601. The communication process will be described below with reference to a detailed flowchart shown in FIG. 25.

Step 9601:

First, it is determined whether a command (character code) is not received from the PC, by checking a reception flag in the third communicating portion 4601. If any command is not received, the process in Block 9600 is brought into an end. If a command is received, the process flow goes to a branch subsequent to STEP 9602.

Step 9602–9606:

The character code is interpreted as a command. More specifically, the process flow goes to a next step in accordance with one of the following five cases depending on an interpreted result:

(1) STEP 9602:
command (character code) is "T" . . . to STEP 9607
(2) STEP 9603:
command (character code) is "E" . . . to STEP 9608
(3) STEP 9604:
command (character code) is "P" . . . to STEP 9609
(4) STEP 9605:
command (character code) is "F" . . . to STEP 9610
(5) STEP 9606:
command (character code) is "W" . . . to STEP 9611
(6) STEP 9606:
command (character code) is other than "W" . . . Block 9600 is brought into an end Step 9607–9611:

When the command is determined, corresponding data recorded in the EEPROM 4602 shown in FIG. 19 is outputted to the PC in any one of STEP 9607–9611. The data is outputted, for example, by such a method that the recorded data is converted into a character code string, characters are sent to the communication register one by one while confirming the status of the transmission flag in the transmission controller of the third communicating portion 4621, and the communicating portion converts the characters into serial data and sends it to the PC 53. Alternatively, the data may be transmitted in the form of a numerical value without being converted into character code.

For example, if the command is determined in STEP 9602 as being "T", the engine start and stop time and the accumulated work time are transmitted in STEP 9607 to the PC from the record of the engine operation in the EEPROM.

PC 53 includes a communicating portion similar to the third communicating portion 4601, and reads the transmitted data through similar processing.

The process in Block 9600 is then brought into an end.

After completion of the process in Block 9600, the process flow returns to Block 9100. Subsequently, the monitor unit 46 repeats the processing of Block 9100–9600. This repetition time provides the processing period Δt described above in connection with the water temperature frequency distribution.

With the arrangement described above, the control units and the monitor units are able to receive data at optimum communication periods via the first common communication line 39 for control and the second common communication line 40 for monitoring, and to execute the respective processes. This embodiment having the above-described arrangement provides advantages as follows.

(1) Since a common communication line being divided into the first common communication line 39 for control and the second common communication line 40 for monitoring, the amount of communication data and the communication frequency are distributed to the two common communication lines 39, 40. Therefore, a common communication line and a processing unit, which are capable of operating at extremely high rates, are not required, and individual pieces of component equipment (control units and monitor units) can be avoided from being complicated and from having an increased cost.

(2) Because of a common communication line being divided into the first common communication line 39 for control and the second common communication line 40 for monitoring, even if any trouble occurs in either control data or monitor data, both types of data are prevented from affecting each other. In particular, it is possible to prevent the machine body of the hydraulic excavator 1 from being stopped upon a trouble occurred in communication of the monitor data.

(3) Because of a common communication line being divided into the first common communication line 39 for control and the second common communication line 40 for monitoring, even if another monitor unit, for example, is additionally connected to the second common communication line 40 for monitoring for the purpose of function enhancement, the amount of communication data and the communication frequency to be handled via the first common communication line 39 for control are not affected, and a flexible system can be constructed (see second embodiment).

<Second Embodiment>

A second embodiment of the present invention will be described with reference to FIGS. 26–33.

Figure 26:
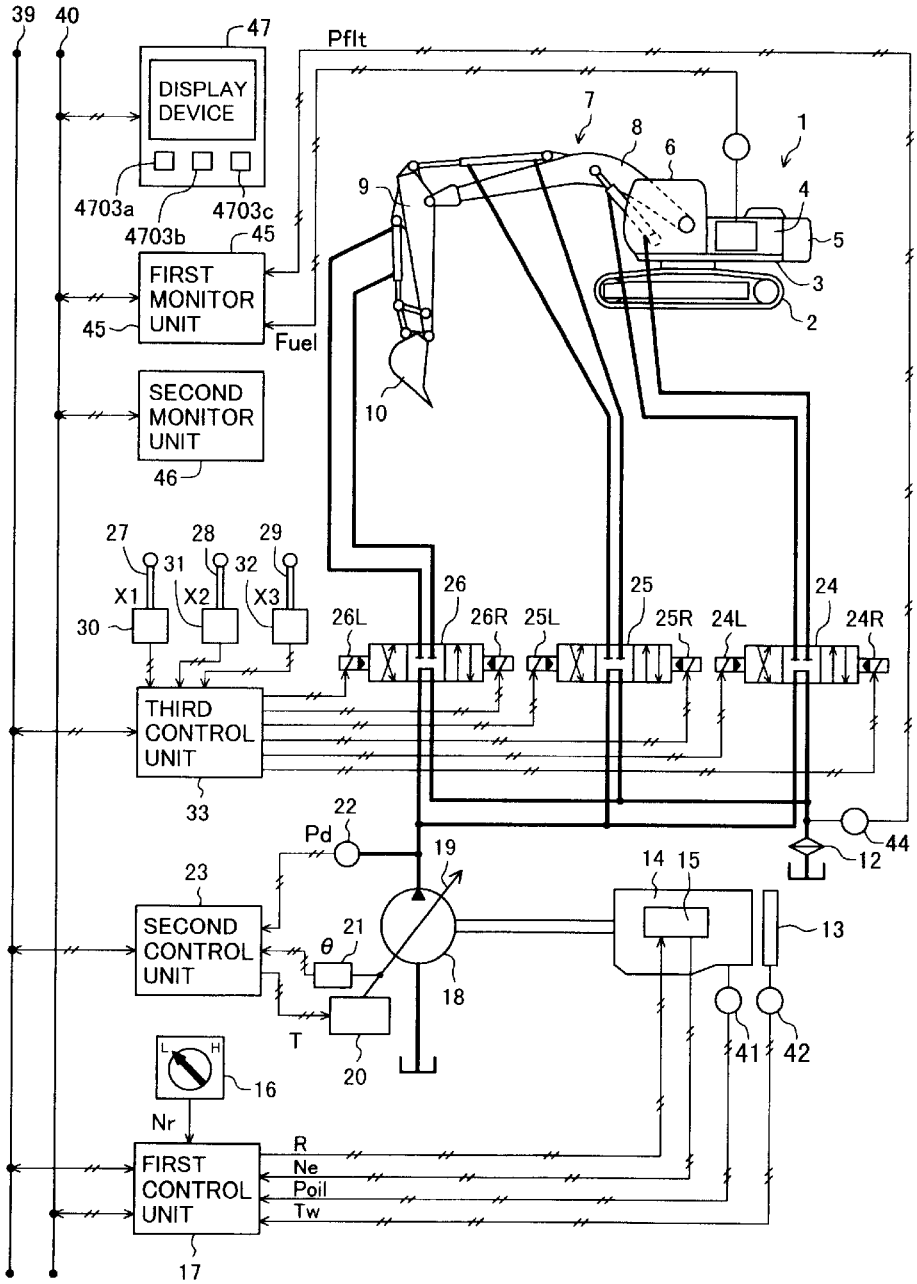
FIG. 26 is a diagram showing an electronic control system for a hydraulic excavator according to a second embodiment of the present invention along with the hydraulic excavator and a hydraulic system.

As shown in FIG. 26, in the second embodiment, a display device 47 is additionally connected to the second common communication line 40 for monitoring in addition to the arrangement of the first embodiment.

Figure 27:
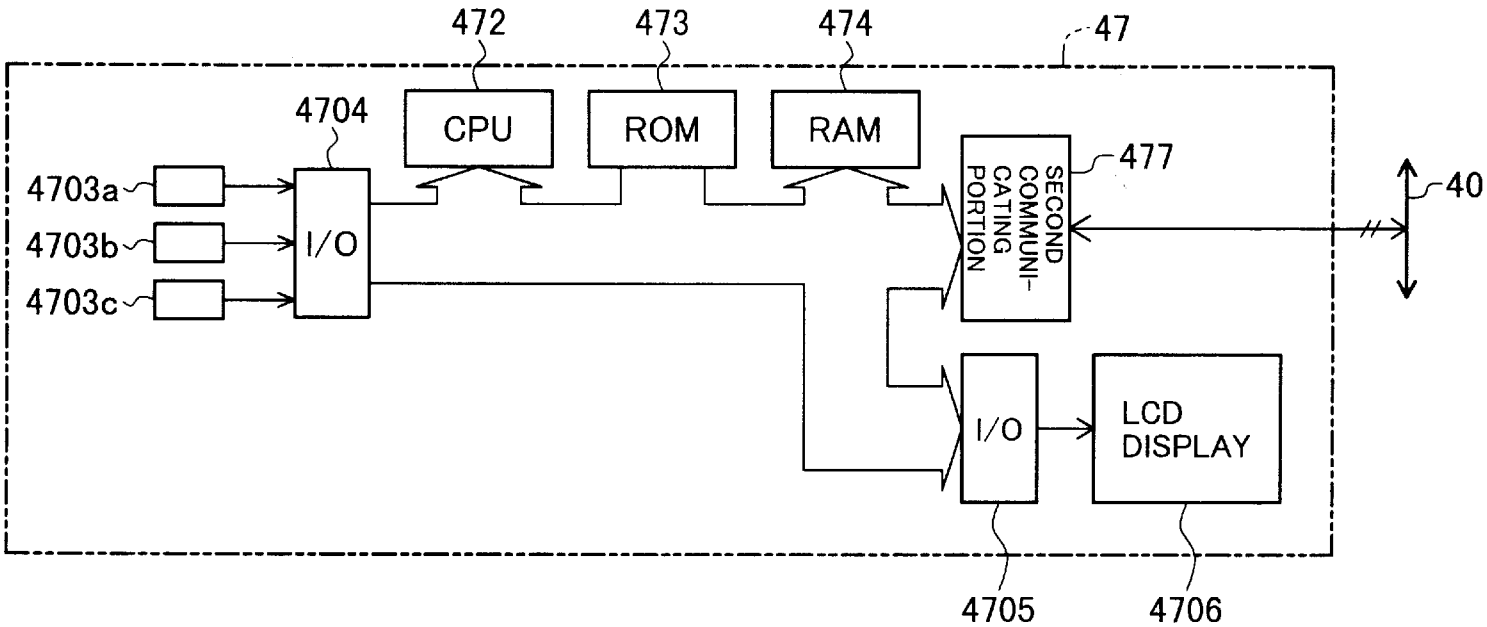
FIG. 27 is a block diagram showing a configuration of a display device shown in FIG. 26.

FIG. 27 shows a configuration of the display device 47. The display device 47 comprises input means 4703*a*, 4703*b* and 4703*c*, such as switches and keys, which are depressed, for example, when an operator wants to change over a display screen; an I/O interface 4704 for receiving signals from the input means 4703*a*, 4703*b* and 4703*c*; a central processing unit (CPU) 472; a read only memory (ROM) 473 for storing programs of control procedures and constants necessary for control; a random access memory (RAM) 474 for temporarily storing numerical values obtained as computation results or in the course of the computation; an interface (I/O) 4705 for outputting; a display portion 4706, such as an LCD, for displaying information; and a second communicating portion 477 for controlling communication with the monitor units connected to the second common communicating line 40.

A table of FIG. 28 lists up transfer relationships among data transmitted and received via the first and second common communication lines 39, 40, and communication periods of the data. In this embodiment, data to be displayed to the operator using the display device 47 is additionally transferred via the second common communication line 40 for monitoring. Also, instead of the instrument panel connected to the first monitor unit 45 in the first embodiment, the display device 47 provides a display equivalent to that made by the instrument panel. Further, the signals such as the work time, the engine oil pressure and the filter pressure, the frequency distribution data of the water temperature Tw, etc., which are recorded in the second monitor unit 46, are transmitted here to the display device 47. To that end, the first and second monitor units 45, 46 transmit those data to the display device 47 using a timer interrupt signal in the same manner as that executed by the first to third control units 17, 23 and 33. The display device 47 receives and displays the transmitted data in a manner of, e.g., changing over them one by one, or combining them to be displayed at the same time.

Figure 29A:
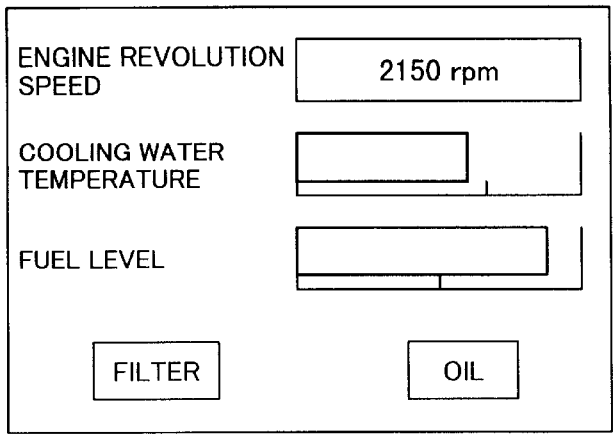
FIGS. 29A, 29B and 29C show examples of a display screen on the display device.
Figure 29B:
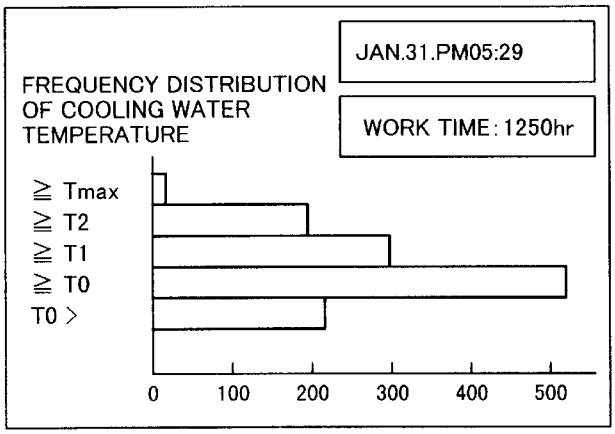
Figure 29C:
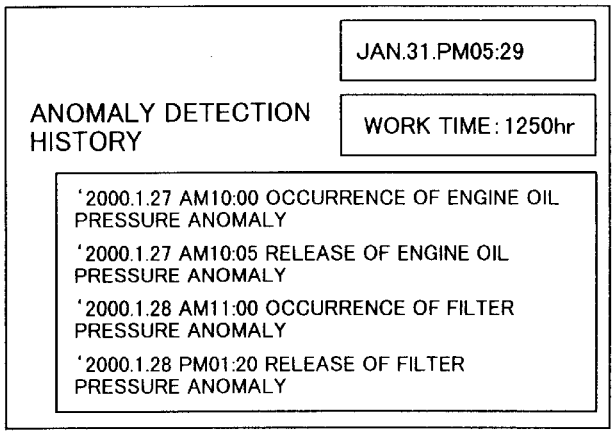

FIGS. 29A, 29B and 29C show, by way of example of the display manner, display screens of the display device 47.

A screen 1 of FIG. 29(A) is a display screen corresponding to an indication provided by the instrument panel connected to the first monitor unit 45. The screen 1 indicates, in the form of numerals or bar graphs, the engine revolution speed Ne and the cooling water temperature Tw, which are received from the first control unit 17, and the fuel level Fuel received from the first monitor unit 45. For the engine oil pressure Poil received from the first control unit 17 via the second common communication line 40 and the filter pressure Pflt received from the first monitor unit 45 via the second common communication line 40, the display device 47 displays relevant item on the screen only when there occurs anomaly in those parameters. Anomaly determination is executed in a similar manner as described above in connection with the process flow executed by the second monitor unit 46, shown in FIGS. 20 and 21, in the first embodiment.

A screen 2 of FIG. 29(B) indicates the work time Tmwork and the cooling-water temperature frequency distribution HisTw, which are collected and recorded in the second monitor unit 46, and the time-of-day Time outputted from the RTC 4603, those data being described above in the first embodiment and received via the second common communication line 40.

A screen 3 of FIG. 29(C) indicates, instead of the cooling-water temperature frequency distribution HisTw in the screen 2, history of engine oil pressure anomaly and filter pressure anomaly which are collected and recorded in the second monitor unit 46 described above in the first embodiment.

Figure 30:
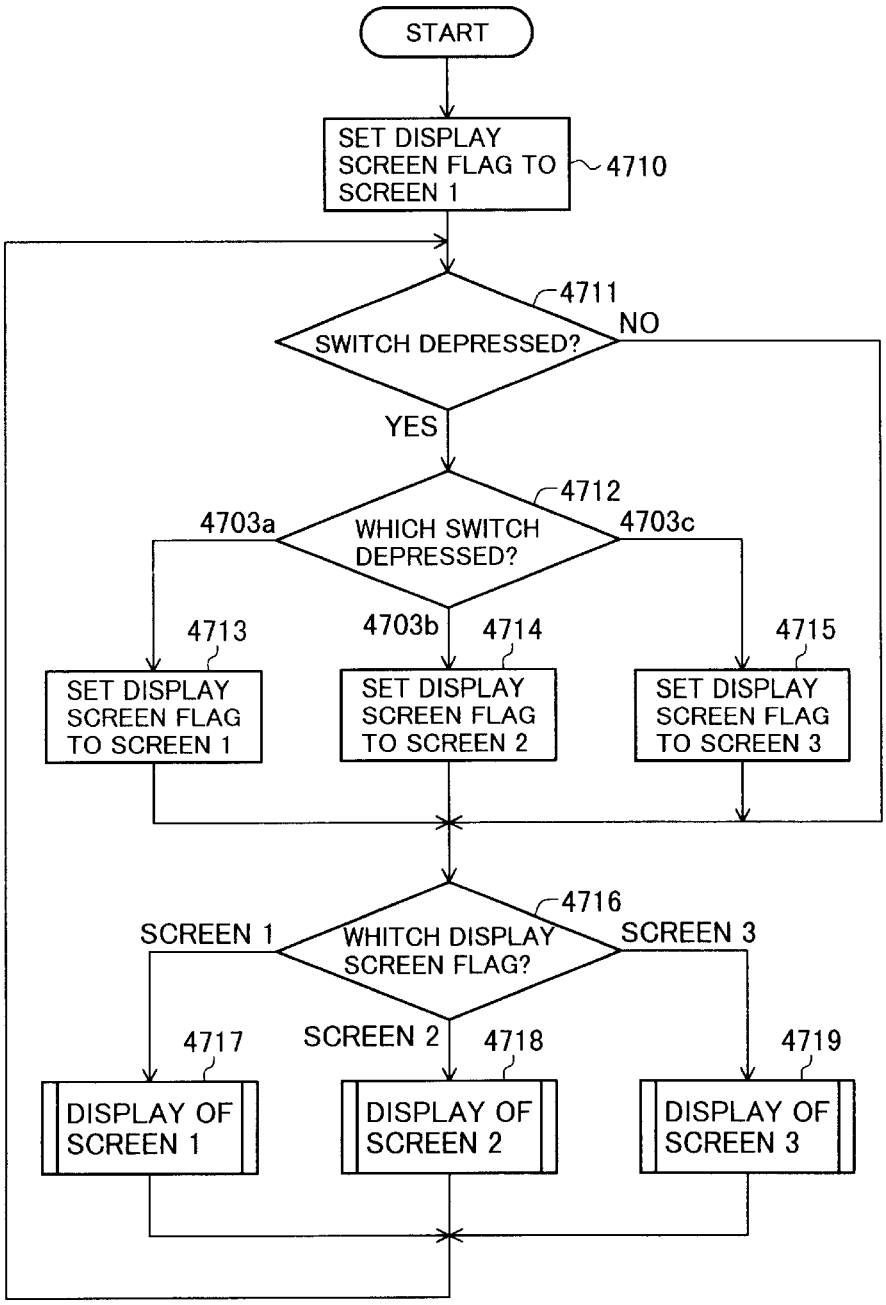
FIG. 30 is a flowchart for explaining a main process of the display device.

FIG. 30 shows a process flow in the display device 47 for displaying those screens. A description is now made of details of the process flow with reference to FIG. 30.

Step 4710:

First, when the display device 47 is started up, a display screen flag indicating which screen is currently displayed is set to the screen 1. Thus, an initial screen is set to the screen 1.

Step 4711:

Then, it is determined whether any of the switches 4703*a*, 4703*b* and 4703*c* provided on the display device 47 is depressed. If not depressed, the process flow goes to STEP 4716. If depressed, the process flow goes to STEP 4712.

Step 4712:

It is determined which one of the switches 4703*a*, 4703*b* and 4703*c* is depressed. The process flow goes to STEP 4713 if the switch 4703*a* is depressed, to STEP 4714 if the switch 4703*b* is depressed, and to STEP 4715 if the switch 4703*c* is depressed.

Step 4713:

The display screen flag is set to the screen 1.

Step 4714:

The display screen flag is set to the screen 2.

Step 4715:

The display screen flag is set to the screen 3. Thus, in STEP 4713, 4714 or 4715, the display screen flag is set to change over the screen depending on which one of the switches is depressed.

Step 4716:

Then, the CPU determines the display screen flag set in STEP 4713, 4714 or 4715. The process flow goes to STEP 4717 if the display screen flag is set to the screen 1, to STEP 4718 if the display screen flag is set to the screen 2, and to STEP 4719 if the display screen flag is set to the screen 3. If it is determined in STEP 4711 that any switch is not depressed, STEP 4716 is executed at once without changing the display screen flag, and therefore the same screen as that in the preceding process cycle is displayed.

Step 4717:

The screen 1 shown in FIG. 29(A) is displayed.

Step 4718:

The screen 2 shown in FIG. 29(B) is displayed.

Step 4719:

The screen 3 shown in FIG. 29(C) is displayed.

After completion of STEP 4717, 4718 or 4719, the process flow returns to STEP 4711 to repeat the processing described above.

Figure 31:
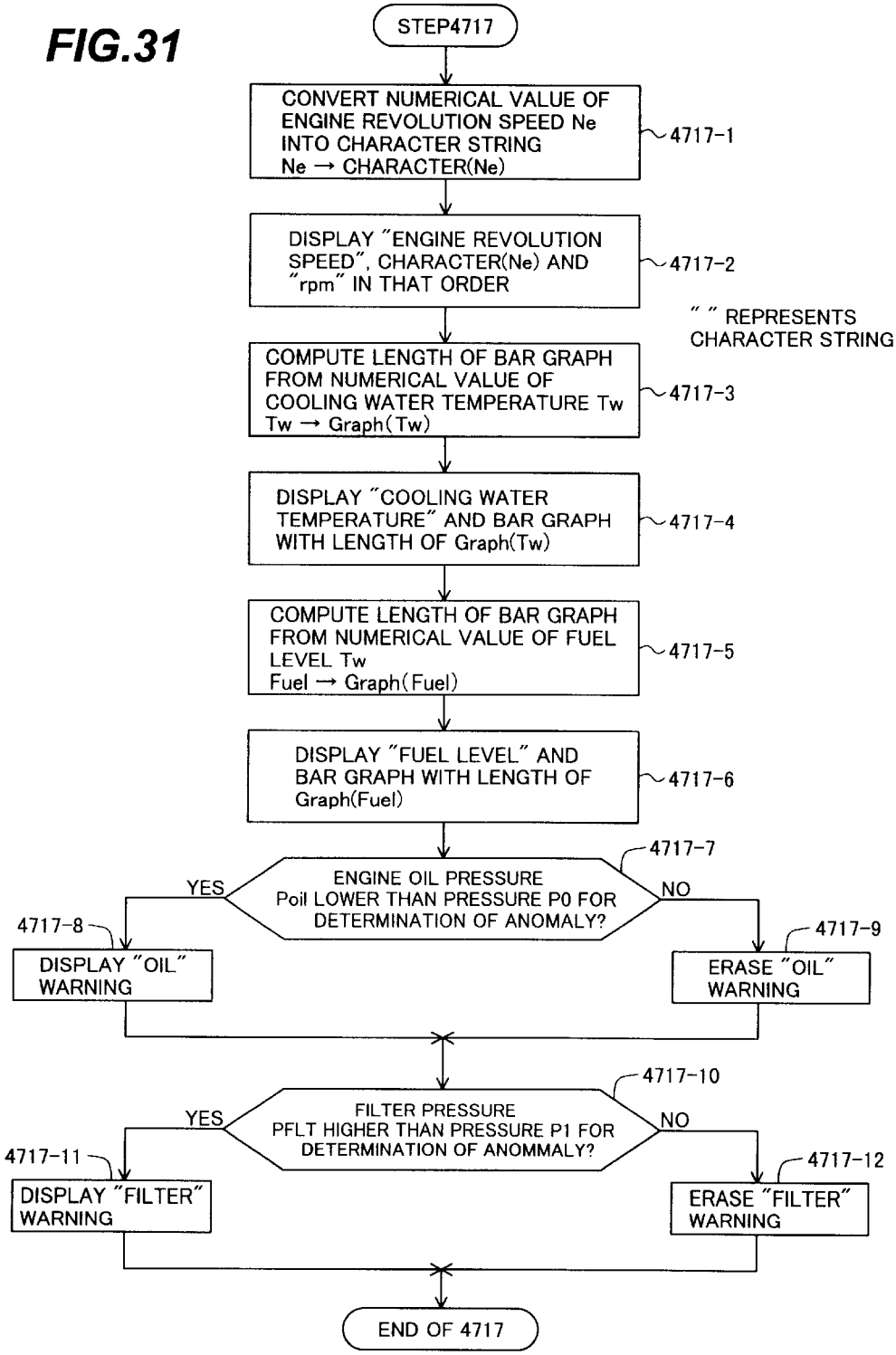
FIG. 31 is a flowchart for explaining details of a process for displaying the screen 1, which is contained in the main process of the display device.

FIG. 31 shows details of the process in STEP 4717. A description is now made of the process in STEP 4717 with reference to FIG. 31.

Step 4717-1:

A numerical value of the engine revolution speed Ne received via the second common communication line 40 is converted into a character string (characters (Ne)) for display (because of Ne: 2150 in the example of the screen 1 shown in FIG. 29(A), the character string is represented by "2", "1", "5" and "0").

Step 4717-2:

A character string "ENGINE REVOLUTION SPEED", the characters (Ne), and a character string "rpm" are displayed in that order. Thus, "ENGINE REVOLUTION SPEED 2150 rpm" is displayed in a first line of the screen 1 of FIG. 29(A).

Step 4717-3:

A length of a bar graph (Graph(Tw)) is calculated from a numerical value of the cooling water temperature Tw received via the second common communication line 40. A calculation formula is as given below:

(Graph(Tw))=(Tw)/(bar graph memory maximum value)*(bar graph maximum length)

Assuming, for example;

cooling water temperature Tw=60° C., bar graph memory maximum value=100° C., and bar graph maximum length=50 pixels, the following result is obtained:

(Graph(Tw))=60/100*50=30 pixels.

Step 4717-4:

A character string "COOLING WATER TEMPERATURE" and (Graph(Tw)) are displayed in that order (second line in the screen 1 of FIG. 29(A)).

Step 4717-5:

As with the process in 4717-3, a length of a bar graph (Graph(Fuel)) is calculated from a numerical value of the fuel level Fuel received via the second common communication line 40.

Step 4717-6:

A character string "FUEL LEVEL" and (Graph(Fuel)) are displayed in that order (third line in the screen 1 of FIG. 29(A)).

Step 4717-7:

It is determined whether the engine oil pressure Poil received via the second common communication line 40 is lower than the anomaly determination value P0. If Poil is lower than P0, i.e., if there occurs anomaly, the process flow goes to STEP 4717-8. If Poil is higher than P0, i.e., if the system is in the normal state, the process flow goes to STEP 4717-9.

Step 4747-8:

A character string "OIL" is displayed (fourth line in the screen 1 of FIG. 29(A), indication of "OIL").

Step 4717-9:

A character string "OIL" is erased.

Step 4717-10:

It is determined whether the filter pressure Pflt is higher than the anomaly determination value P1. If Pflt is higher than P1, i.e., if there occurs anomaly, the process flow goes to STEP 4717-11. If Pflt is lower than P0, i.e., if the system is in the normal state, the process flow goes to STEP 4717-12.

Step 4747-11:

A character string "FILTER" is displayed (fourth line in the screen 1 of FIG. 29(A), indication of "FILTER").

Step 4717-12:

A character string "FILTER" is erased.

The process in STEP 4717 is then brought into an end.

Figure 32:
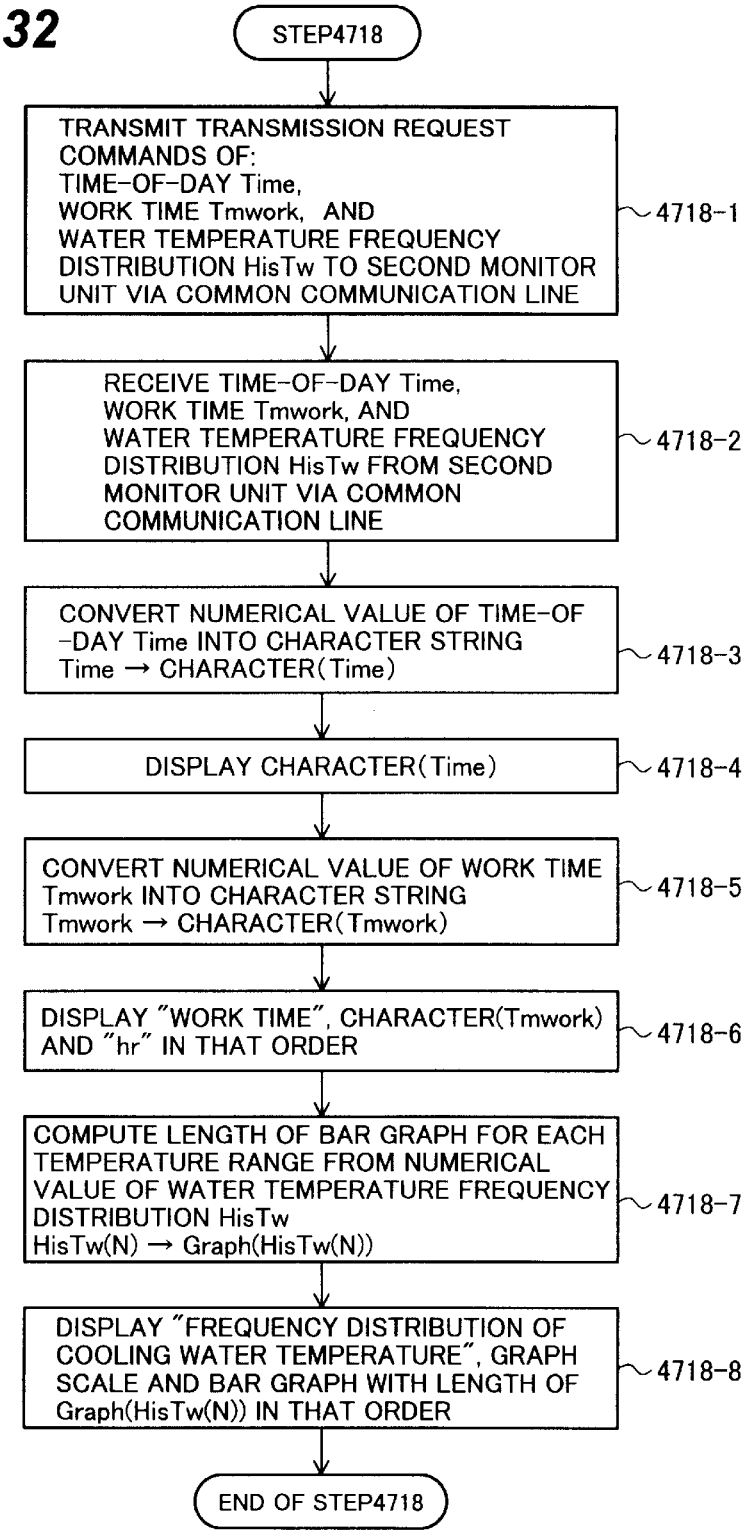
FIG. 32 is a flowchart for explaining details of a process for displaying the screen 2, which is contained in the main process of the display device.

FIG. 32 shows details of the process in STEP 4718 in FIG. 30. A description is now made of the process in STEP 4718 with reference to FIG. 32.

Step 4718-1:

Display data on the screen 2 shown in FIG. 29(B) is not communicated at intervals of a certain time as seen from FIG. 28, and is transferred as communication data through a manner of receiving necessary data from the second monitor unit 46 in response to a data transmission request issued from the display device 47. More specifically, when the switch 4703*b* on the display device 47 is depressed, STEP 4714 and 4718 in the flowchart of FIG. 30 are selected and, at the same time, transmission request commands for the time-of-day Time, the work time Tmwork and the water temperature frequency distribution HisTw are sent to the second monitor unit 46 via the second common communication line 40 in this STEP 4718-1 of STEP 4718.

Step 4718-2:

As a response to the transmission request commands sent in above STEP, the display device receives data of the time-of-day Time, the work time Tmwork and the water temperature frequency distribution HisTw, which are collected and stored in the second monitor unit.

Step 4718-3:

A numerical value of the data of the time-of-day Time is first converted into a character string (Time) for display.

Step 4718-4:

A character string (Time) is displayed. For example, "JAN. 31, PM 05:29" is displayed in a first line of the screen 2 of FIG. 29(B).

Step 4718-5:

Then, a numerical value of the work time Tmwork is converted into a character string (Tmwork) for display.

Step 4718-6:

A character string "WORK TIME", the character string (Tmwork) and a character string "hr" are displayed. For example, "WORK TIME: 1250 hr" is displayed in a second line of the screen 2 of FIG. 29(B) on the right side thereof.

Step 4718-7:

A length of a bar graph for each temperature range is calculated from a numerical value of the water temperature frequency distribution HisTw. The calculated result is represented by a pattern Graph(HisTw(N)) wherein N denotes each of the divided temperature ranges. A calculation formula is as given below:

(Graph(HisTw(N))=(HisTw(N))/(bar graph memory maximum value)*(bar graph maximum length)

Assuming, for example, in the range of Tw;

HisTw=10 hr, bar graph memory maximum value=500 hr, and bar graph maximum length=50 pixels, the following result is obtained:

(Graph(HisTw(N))=10/500*50=1 pixel.

Step 4718-8:

A character string "COOLING-WATER TEMPERATURE FREQUENCY DISTRIBUTION", a graph scale, and a bar graph of (Graph(HisTw(N)) are displayed in that order. Thus, "cooling-water temperature frequency distribution" is indicated in the second line of the screen 2 of FIG. 29(B) on the left side thereof, and respective bar graphs are indicated in an area of the screen 2 under a middle column.

The process in STEP 4718 is then brought into an end.

Figure 33:
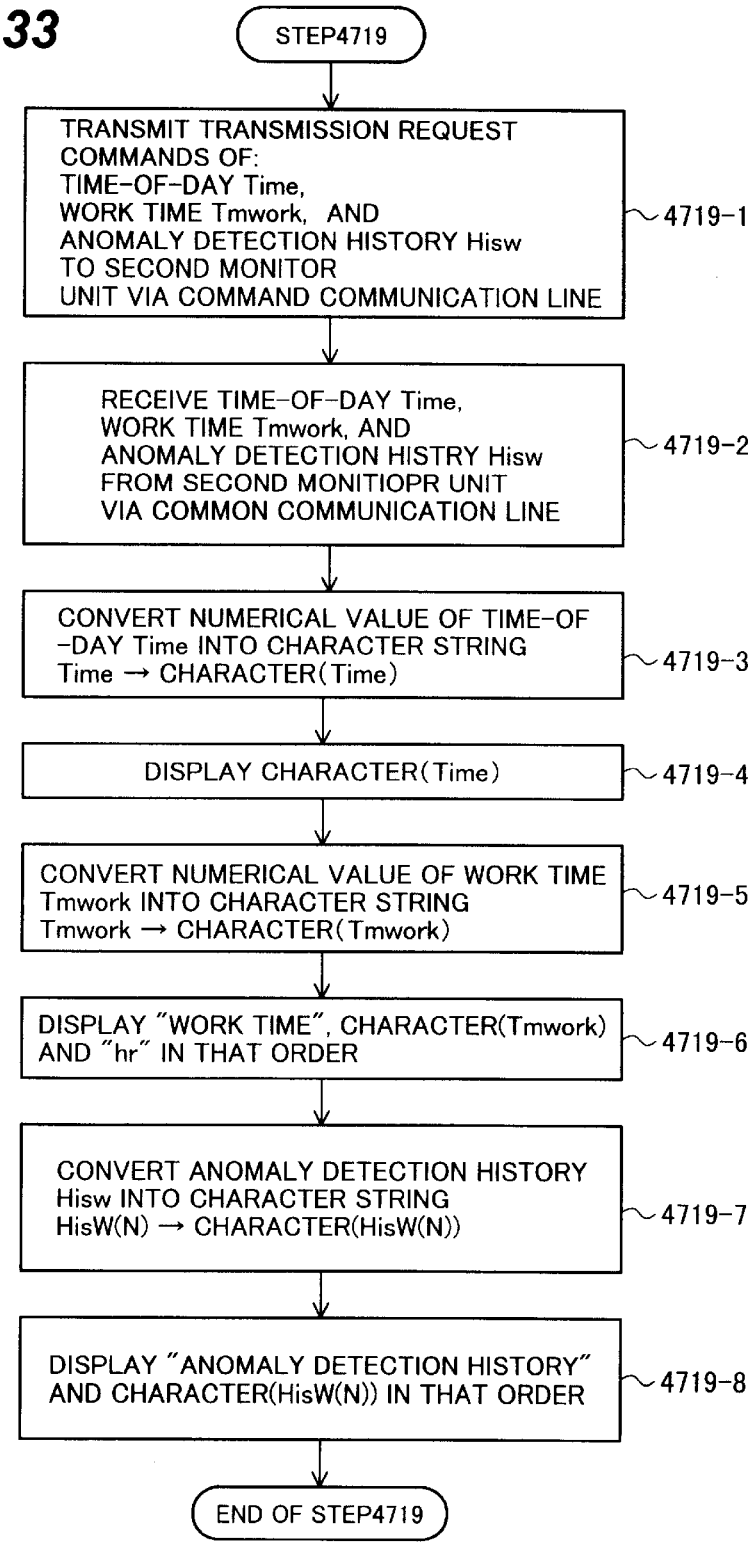
FIG. 33 is a flowchart for explaining details of a process for displaying the screen 3, which is contained in the main process of the display device.

FIG. 33 shows details of the process in STEP 4719. A description is now made of the process in STEP 4719 with reference to FIG. 33.

Step 4719-1:

As with the data handled in STEP 4718, display data on the screen 3 shown in FIG. 29(C) is also not communicated at intervals of a certain time as seen from FIG. 28, and is transferred as communication data through a manner of receiving necessary data from the second monitor unit 46 in response to a data transmission request issued from the display device 47. More specifically, when the switch 4703*c* on the display device 47 is depressed, STEP 4715 and 4719 in the flowchart of FIG. 30 are selected and, at the same time, transmission request commands for the time-of-day Time, the work time Tmwork and the anomaly detection history HisW are sent to the second monitor unit 46 via the second common communication line 40 in this STEP 4719-1 of STEP 4719.

Step 4719-2:

As a response to the transmission request commands sent in above STEP, the display device receives data of the time-of-day Time, the work time Tmwork and the anomaly detection history HisW, which are collected and stored in the second monitor unit 46.

Step 4719-3:

A numerical value of the data of the time-of-day Time is first converted into a character string (Time) for display.

Step 4719-4:

A character string (Time) is displayed. For example, "JAN. 31, PM 05:29" is displayed in a first line of the screen 3 of FIG. 29(C).

Step 4719-5:

Then, a numerical value of the work time Tmwork is converted into a character string (Tmwork) for display.

Step 4719-6:

A character string "WORK TIME", the character string (Tmwork) and a character string "hr" are displayed. For example, "WORK TIME: 1250 hr" is displayed in a second line of the screen 3 of FIG. 29(C) on the right side thereof.

Step 4719-7:

Information of the anomaly detection history HisW is converted into a character string (HisW(N)) wherein N denotes anomaly information for each item.

Step 4719-8:

A character string "ANOMALY DETECTION HISTORY" and a character string (HisW(N)) are displayed. Thus, "ANOMALY DETECTION HISTORY" is indicated in the second line of the screen 3 of FIG. 29(C) on the left side thereof, and respective items of anomaly detection information are indicated in an area of the screen 3 under a middle column.

The process in STEP 4719 is then brought into an end.

After completion of any of STEP 4717, 4718 and 4719, the process flow returns to STEP 4711.

With this embodiment having the arrangement described above, because of a common communication line being divided into the first common communication line 39 for control and the second common communication line 40 for monitoring, even if the display device 47 (one kind of monitor unit) is additionally connected to the second common communication line 40 for monitoring for the purpose of function enhancement, the amount of communication data and the communication frequency to be handled via the first common communication line 39 for control are not affected, and a flexible system can be constructed (advantage (3) with the first embodiment).

Also, with this embodiment, since the display device 47 is additionally connected to the second common communication line 40 for monitoring, the following advantages are further obtained in addition to the advantages (1) to (3) with the first embodiment.

(4) Since the display device 47 is connected to the second common communication line 40 for monitoring, the monitor data can be displayed to the operator without causing any influences upon the control performance.

(5) Since the monitor data is displayed on the display device 47 in the graphical form, the displayed monitor data is more easily recognizable by the operator.

<Third Embodiment>

A third embodiment of the present invention will be described with reference to FIGS. 34–42.

Figure 34:
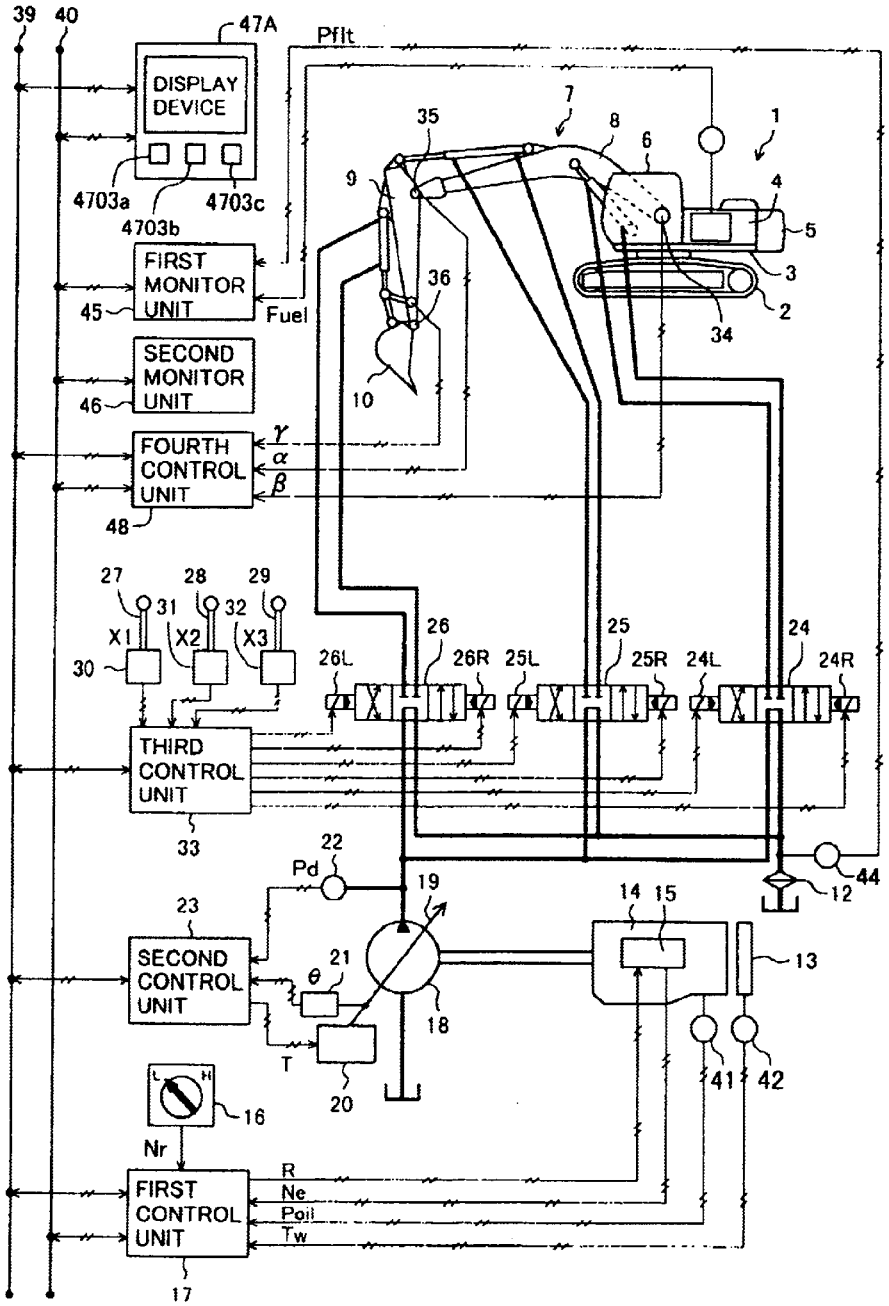
FIG. 34 is a diagram showing an electronic control system for a construction machine according to a third embodiment of the present invention, along with a hydraulic excavator and a hydraulic system.

As shown in FIG. 34, in this embodiment, a fourth control unit 48 for controlling the excavating device 7 is additionally provided in addition to the system arrangement of the second embodiment. Further, a display device 47A is connected to the first common communication line 39 for control.

The excavating device 7 is provided with a boom rotational angle sensor 34 for detecting the rotational angle of the boom 8, an arm rotational angle sensor 35 for detecting the rotational angle of the arm 9, and a bucket rotational angle sensor 36 for detecting the rotational angle of the bucket 10.

The fourth control unit 48 executes predetermined arithmetic processing based on rotational angle signals $\beta$, $\alpha$, land $\gamma$ from the rotational angle sensors 34, 35 and 36, and supplies control driving commands $Y\beta$, $Y\alpha$ and $Y\gamma$ to the third control unit 33.

Figure 35:
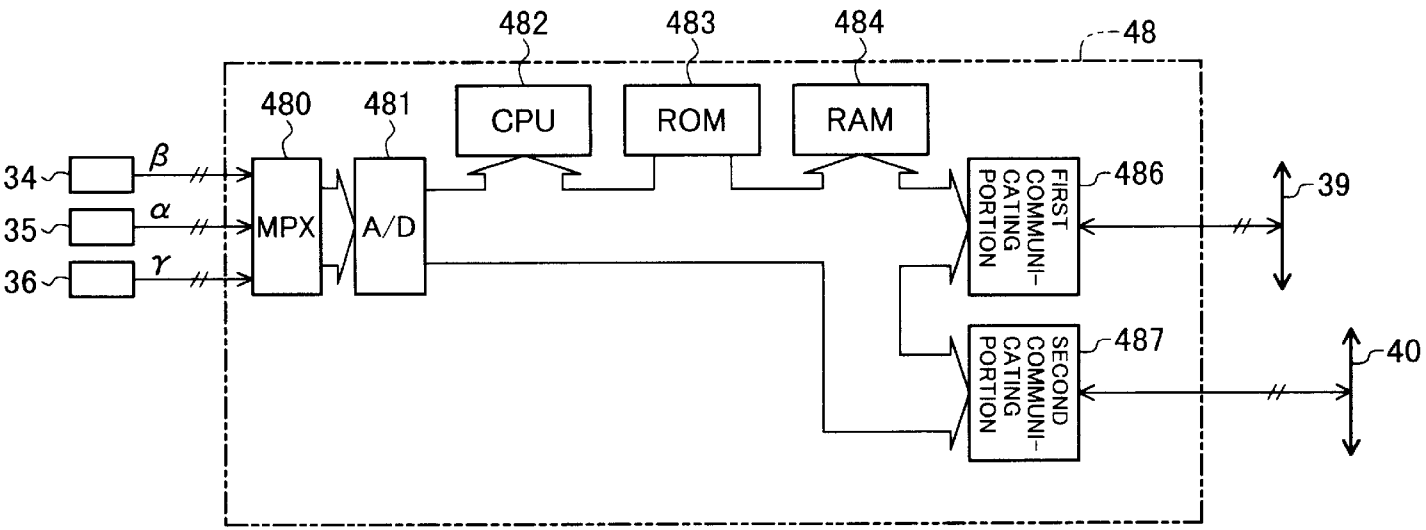
FIG. 35 is a block diagram showing a configuration of a fourth control unit shown in FIG. 34.

FIG. 35 shows a configuration of the fourth control unit 48. The control unit 48 comprises a multiplexer 480 for outputting, to an A/D converter 481, the angle signals $\beta$, $\alpha$, and $\gamma$ for the boom, the arm and the bucket of the excavating device in a switching manner; the A/D converter 481 for converting an analog signal inputted from the multiplexer 480 into a digital signal; a CPU 482 for controlling the whole of the control unit in accordance with control procedures stored in a ROM 483; the ROM 483 for storing the control procedures; a RAM 484 for temporarily storing data obtained in the course of computation; a first communicating portion 486 for communicating with the common communicating line 39 for control system; and a second communicating portion 487 for communicating with the second common communicating line 40 for monitoring.

Figure 36:
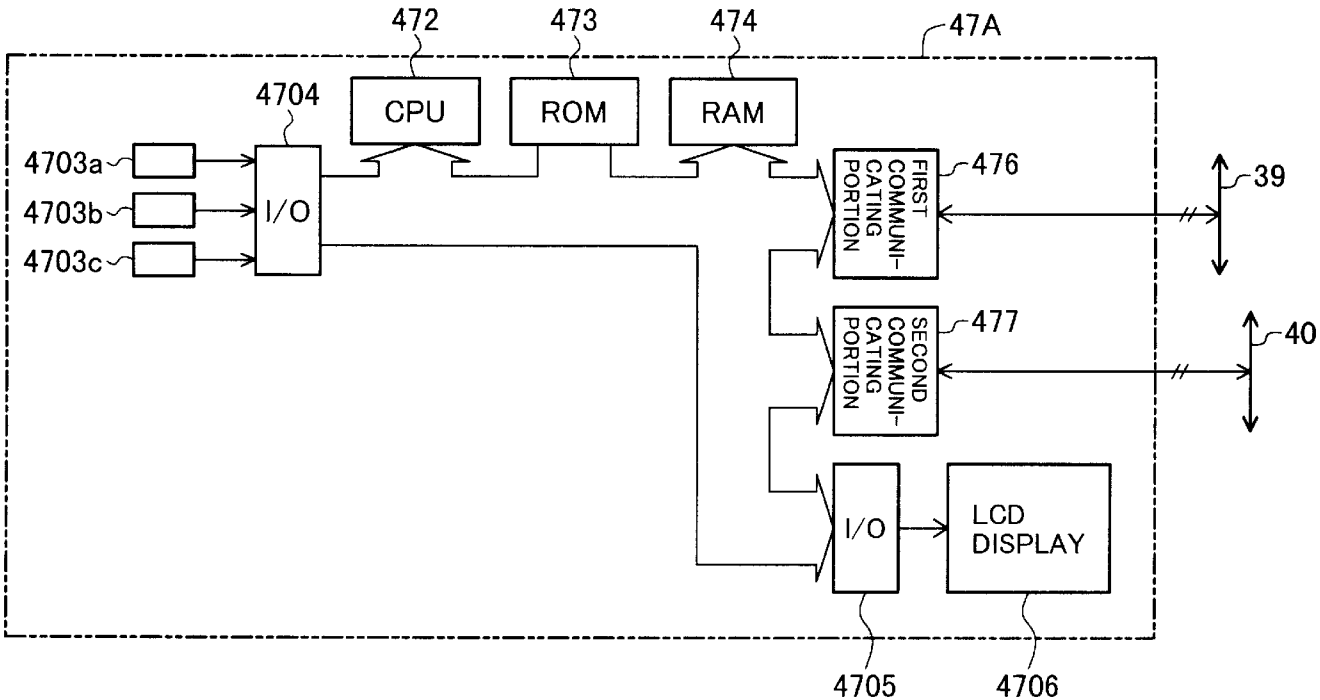
FIG. 36 is a block diagram showing a configuration of a display device shown in FIG. 34.

FIG. 36 shows a configuration of the display device 47A. The display device 47A includes, in addition to the components of the display device 47 in the second embodiment, a first communicating portion 476 for controlling communication with the control units connected to the first common communicating line 39.

FIG. 37 lists up data transferred via the first and second common communication lines 39, 40, and transfer relationships and communication periods of the data. In addition to the functions of the above second embodiment, this embodiment is designed to have functions of displaying the status of the excavating device 7 on the display device 47A, which is computed by the control unit 48, and of communicating control target values (automatic operation command Cauto and target locus hr) from the display device 47A to the control unit 48. Of those functions, the display of the status of the excavating device 7 is performed using the second common communicating line 40 for monitoring, and data related to control is transferred via the first common communication line 39 for control.

Figure 38:
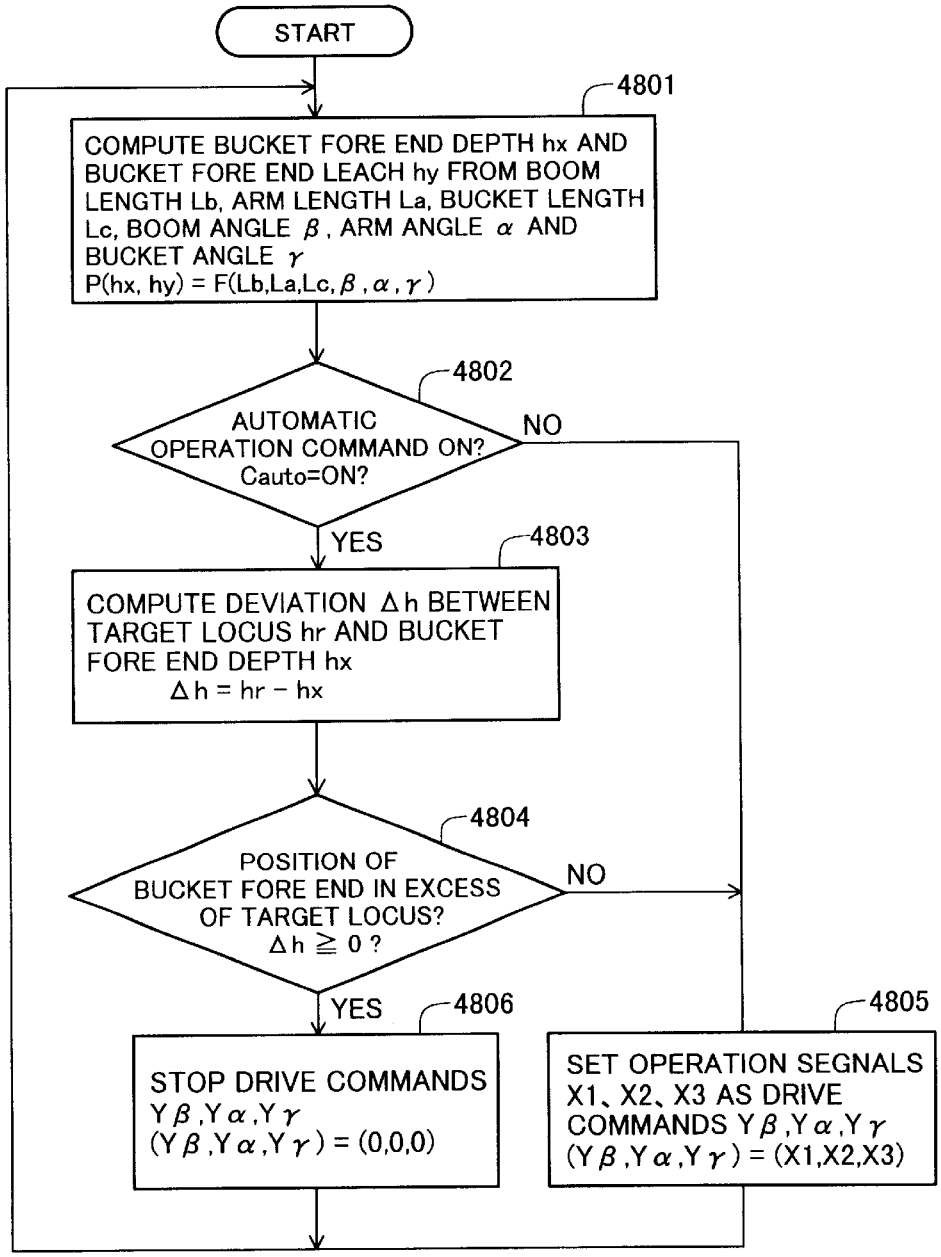
FIG. 38 is a flowchart for explaining a main process of the fourth control unit.

A flowchart of FIG. 38 shows processing steps stored in the ROM 483 of the fourth control unit 48. This process represents, by way of example, area limiting control under which the excavating device 7 is stopped when the bucket end reaches a setting depth. A description is now made of details of such a process with reference to FIG. 38.

Step 4801:

A position of the end of the bucket 10, a depth hx and a leach hy are computed from lengths Lb, La and Lc of the boom 8, the arm 9 and the bucket 10, which are stored as basic data in the ROM 483 of the control unit 48, and from the boom angle β, the arm angle α and the bucket angle γ outputted from the angle sensors 34, 35 and 36. Herein, a numerical value of the depth hx is represented on condition that the ground level is 0 and the depth direction is negative (−).

Step 4802:

It is determined whether the automatic operation command Cauto (described later) sent from the display device 47A via the common communicating line 39 is "ON". If not "ON", the process flow goes to STEP 4805. If "ON", i.e., if area limitation is to be carried out, the process flow goes to STEP 4803.

Step 4803:

A deviation Δh is computed by subtracting the bucket end depth hx from the target locus hr sent from the display device 47A via the common communicating line 39 (i.e., from the setting depth in this case because the area limiting control is performed).

Step 4804:

Whether the bucket end position exceeds the target locus (setting depth) or not is determined by confirming whether the depth deviation Δh computed in the above step is equal to or greater than 0. If $\Delta h \geqq 0$, i.e., if the bucket end reaches a depth in excess of the setting depth, the process flow goes to STEP 4806. If $\Delta h<0$, i.e., if the bucket end does not yet reach the setting depth, the process flow goes to STEP 4805.

Step 4805:

The process of this step is executed when it is determined in STEP 4802 that Cauto is "OFF", or when it is determined in STEP 4804 that the bucket end does not yet reach the setting depth. In this process, the operation signals X1, X2 and X3 received from the control unit 33A via the first common communication line 39 are substituted for the driving commands Yβ, Yα and Yγ sent to the control unit 33A via the first common communication line 39, respectively, so that the control unit 33A drives the control valves 24, 25 and 26 as per the operation commands.

Step 4806:

The process of this step is executed when it is determined in STEP 4804 that the bucket end has reached a depth in excess of the setting depth. In this process, the driving commands Yβ, Yα and Yγ sent to the control unit 33A via the first common communication line 39 are all set to 0 so that the control unit 33A stops the driving of the control valves 24, 25 and 26.

After completion of STEP 4805 or 4806, the process flow returns to STEP 4801.

Figure 39:
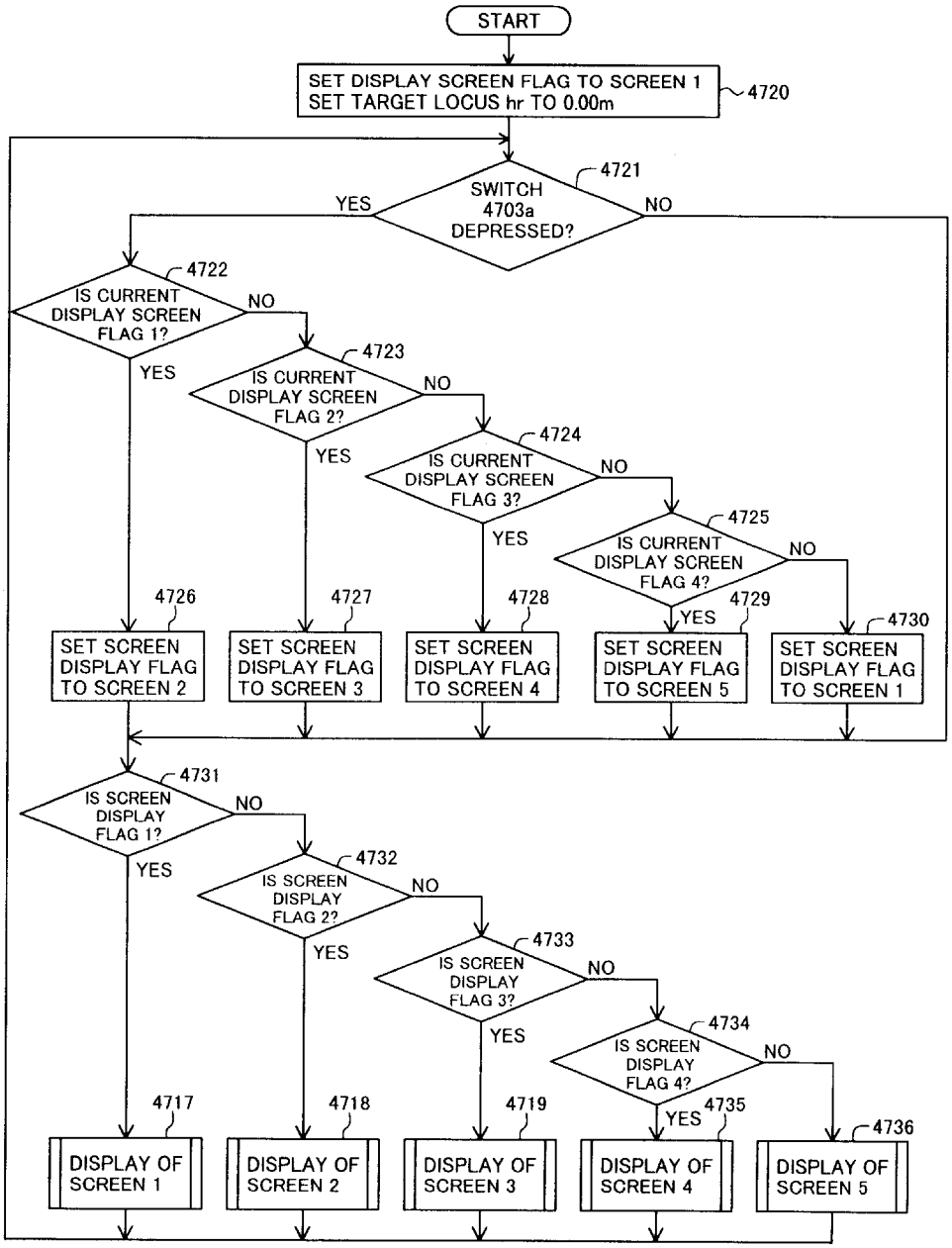
FIG. 39 is a flowchart for explaining a main process of the display device in the third embodiment.
Figure 40A:
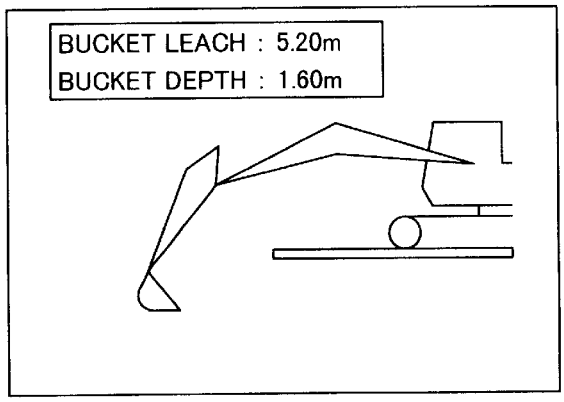
FIGS. 40A and 40B show examples of a display screen on the display device in the third embodiment.
Figure 40B:
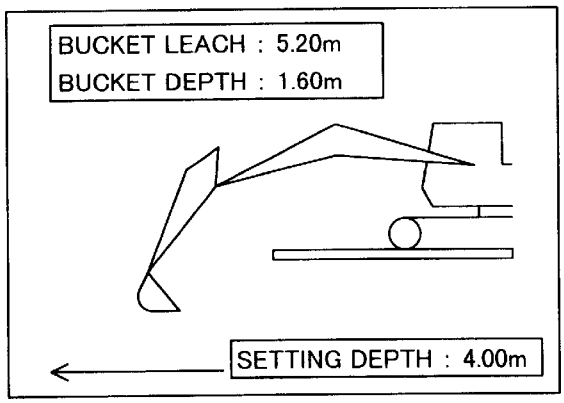

A description is now made of a process executed by the display device 47A. A flowchart of FIG. 39 shows processing steps in the display device 47A. The display device 47A differs from the display device 47 in the second embodiment, shown in FIG. 26, in that screens 4, 5 shown in FIGS. 40(A) and 40(B) are prepared in addition to the above-described screens 1, 2 and 3. A screen 4 shown in FIG. 40(A) indicates the position of the excavating device 7, which is computed by the fourth control unit 48, by drawing a picture of the hydraulic excavator, and a screen 5 shown in FIG. 40(B) is displayed for the target locus (setting depth) in the area limiting control. Further, in this embodiment, the switches 4703*a*, 4703*b* and 4703*c* on the display device are used in different ways from those in the second embodiment. The process of the display device 47A will now be described in detail with reference to FIG. 39.

Step 4720:

First, initialization is executed. In this step, the display screen flag described above is set to the screen 1 and the value of the target locus hr is set to 0.00 m.

Step 4721:

It is determined whether the switch 4703*a* is depressed. If not depressed, the process flow goes to STEP 4731. If depressed, the CPU executes processes in STEP 4722–4730.

Step 4722–4730:

Whenever the switch 4703*a* is depressed, the currently set display screen flag is determined to update setting to the next screen. For example, if the switch 4703*a* is depressed in the condition where the display screen flag is currently set to the screen 1, the CPU determines in STEP 4722 that the currently set display screen flag indicates the screen 1, and the display screen flag is updated to the screen 2 in STEP 4726. Also, if the display screen flag is currently set to the screen 5, the process of STEP 4730 is executed and the display screen flag is updated to the screen 1.

Step 4731–4736:

In these steps, any of the screens 1 to 5 is displayed in accordance with the display screen flag set through above STEP 4722–4730. STEP 4717, 4718 and 4719 are each the same process as that executed in above STEP denoted by the same numeral in FIG. 30. However, STEP 4718-1 and STEP 4719-1 of the flowchart shown in FIGS. 31 and 32 as details of STEP 4718 and 4719 are modified in this embodiment such that the transmission request command for the monitor data is created and transmitted upon operation of the switch 4703*a* instead of the switch 4703*b* or 4703*c*.

After completion of STEP 4731 to 4736, the process flow returns to STEP 4721.

Figure 41:
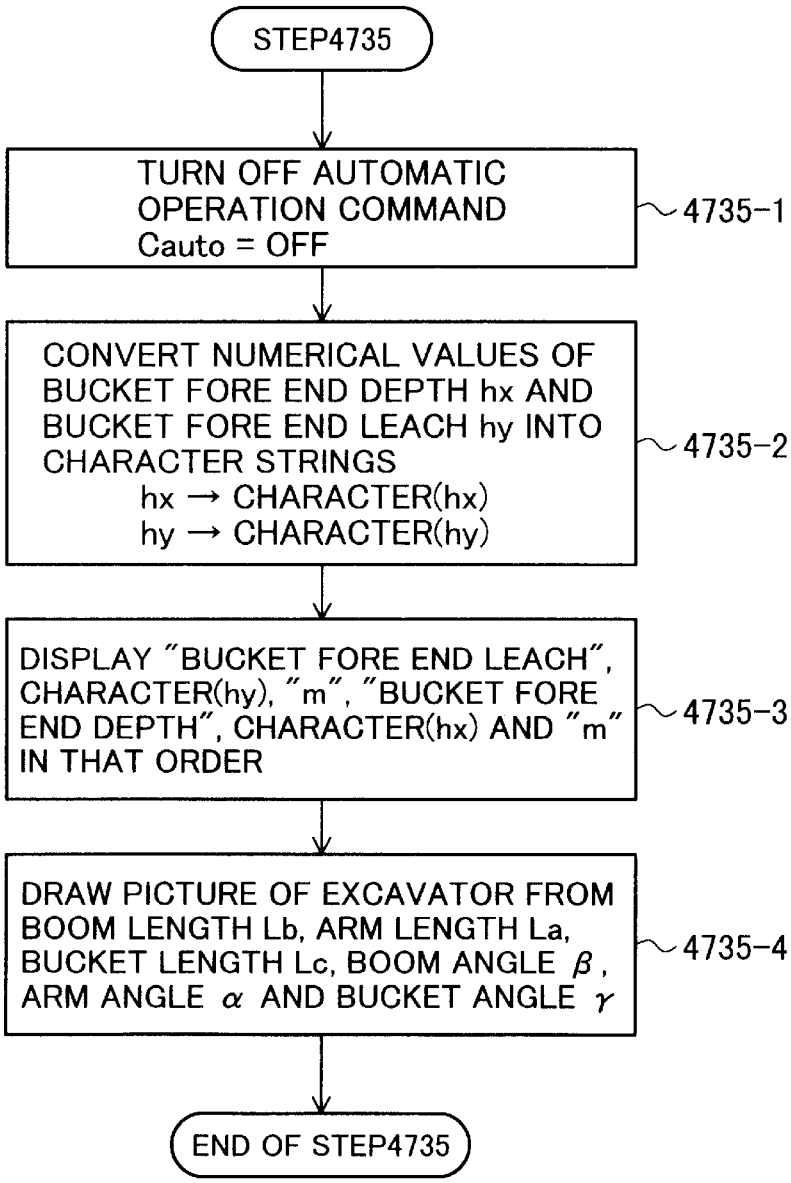
FIG. 41 is a flowchart for explaining details of a process for displaying the screen 4, which is contained in the main process of the display device.

A flowchart of FIG. 41 shows details of STEP 4735. A description is now made of a process for displaying the screen 4 with reference to FIG. 41.

Step 4735-1:

In the screen 4, the area limiting control is cleared and only the status of the excavating device 7 is displayed. In this STEP, therefore, the automatic operation command Cauto is turned off.

Step 4735-2:

The bucket end depth hx and the leach hy, which are both transmitted from the fourth control unit 48 via the second common communication line 40, are converted into character strings for display, i.e., characters (hx) and characters (hy).

Step 4735-3:

"BUCEKT END LEACH", the characters (hy), "m", "BUCKET END DEPTH", the characters (hx), and "m" are displayed in an upper area of the screen 4.

Step 4735-4:

A picture of the hydraulic excavator is drawn in an area of the screen 4 spreading from a central portion toward a lower side based on information of the lengths Lb, La and Lc of the boom 8, the arm 9 and the bucket 10 and the boom angle β, the arm angle α and the bucket angle γ outputted from the angle sensors 34, 35 and 36.

The process in STEP 4735 is then brought into an end.

Details of STEP 4736 will be described below with reference to FIG. 42.

Step 4736-1:

In the screen 5, the area limiting control is made effective. In this STEP, therefore, the automatic operation command Cauto is turned on.

Step 4736-2:

The bucket end depth hx and the leach hy, which are both transmitted from the fourth control unit 48 via the second common communication line 40, are converted into character strings for display, i.e., characters (hx) and characters (hy).

Step 4736-3:

"BUCEKT END LEACH", the characters (hy), "m", "BUCKET END DEPTH", the characters (hx), and "m" are displayed in an upper area of the screen 5.

Step 4736-4:

A picture of the hydraulic excavator is drawn in an area of the screen 5 spreading from a central portion toward a lower side based on information of the lengths Lb, La and Lc of the boom 8, the arm 9 and the bucket 10 and the boom angle $\beta$, the arm angle $\alpha$ and the bucket angle $\gamma$ outputted from the angle sensors 34, 35 and 36.

Step 4736-5 to -9:

In these steps, the target locus hr is set. The setting is performed such that whenever the switch 4703*b* is depressed, $\delta$h is added to the target locus hr stored in the display device 47A, and whenever the switch 4703*c* is depressed, $\delta$h is subtracted from the target locus hr. An increment value $\delta$h is set to, e.g., 0.01 m beforehand.

Step 4736-10:

A numerical value of the target locus hr is converted into a character string for display, i.e., characters (hr).

Step 4736-11:

"SETTING DEPTH", the characters (hr), and "m" are displayed in that order at the bottom of the screen 5.

Step 4736-11:

As shown in the screen 5, a straight line is drawn in the picture of the hydraulic excavator at a position corresponding to the target locus (setting depth) hr.

Step 4736-12:

The process in STEP 4736 is then brought into an end.

With this embodiment having the arrangement described above, the following advantages are obtained in addition to the advantages (1) to (5) with the first and second embodiments.

(6) Since the display device 47 is connected to both the common communication line 39 for control and the common communication line 40 for monitoring, not only the monitor data but also the control data can be displayed on the same display device 47. Even in the cab 6 of a construction machine or the like having a relatively narrow space, therefore, it is possible to display the monitor data and the control data to the operator by installing a single unit of the display device 47.

(7) Since the display device 47 displays the control data and the monitor data in the graphical form, both the monitor data and the control data, such as information regarding the body control, can be displayed to the operator in a more easily recognizable manner.

Figure 42:
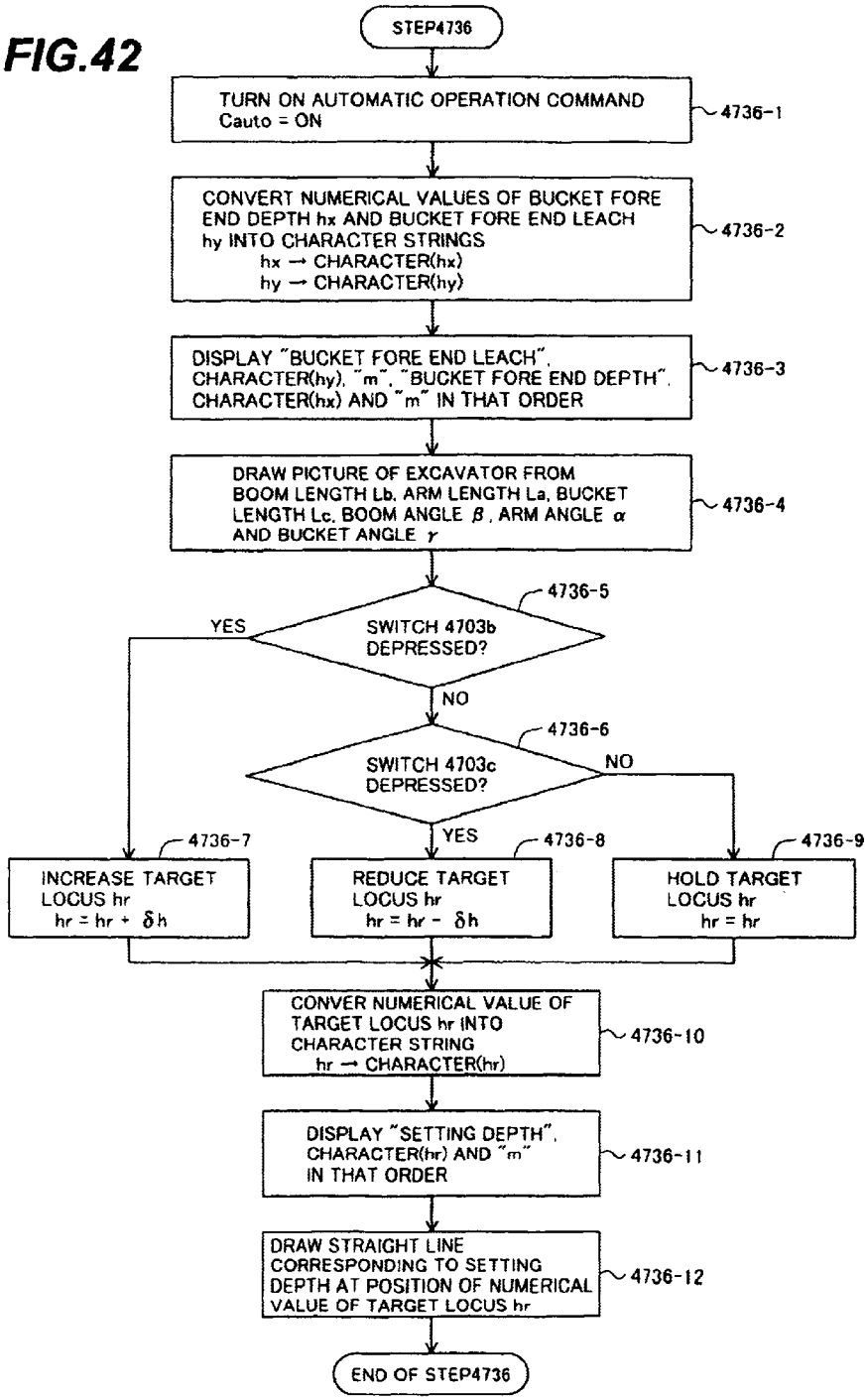
FIG. 42 is a flowchart for explaining details of a process for displaying the screen 5, which is contained in the main process of the display device.

(8) A command signal for control or monitoring is generated and transmitted in conjunction with the contents of a display screen upon operation of the input means 4703*a*, 4703*b* and 4703*c* on the display device 47 (namely, generation and transmission of the transmission request command for the monitor data upon operation of the switch 4703*a* in STEP 4718, 4719 of FIG. 39 (see description related to generation and transmission of the transmission request command for the monitor data upon operation of the switches 4703*b*, 4703*c* in STEP 4718-1 of FIG. 31 and STEP 4719-1 of FIG. 32); and generation of the automatic operation command Cauto and the target locus hr and transmission thereof through the timer interrupt process upon operation of the switches 4703*a*, 4703*b* and 4703*c* in STEP 4802, 4803 of FIG. 38 and STEP 4736-1, 4736-5 to 9 of FIG. 42). Therefore, both the fourth control unit 48 and the second monitor unit 46 can be operated from the display device 47, thus resulting in less intricacy in the operation.

(9) Since there is no need of installing the display device 47 in plural number, the system cost is reduced.

In the above-described embodiments, two systems of common communication lines, i.e., the first common communication line 39 for control and the second common communication line 40 for monitoring, are provided as common buses for data communication. With an increase in the control data or the monitor data, however, the number of the first common communication line 39 or the second common communication line 40 may be increased to provide three or more systems of common communication lines. Also, in the above-described embodiments, two kinds of data, i.e., the control data and the monitor, are employed as communication data. However, in a hydraulic excavator equipped with audio equipment and other associated equipment, audio data and switch-system data for those equipment may be transmitted via the second common communication line 40 or via a third common communication line additionally provided for specific purpose.

INDUSTRIAL APPLICABILITY

According to the present invention, the following advantages are obtained.

(1) Since a common communication line is divided into at least a line for control and a line for monitoring, the amount of communication data and the communication frequency are distributed to the two common communication lines. Therefore, a common communication line and a processing unit, which are capable of operating at extremely high rates, are not required, and individual pieces of component equipment can be avoided from being complicated and from having an increased cost.

(2) Because of a common communication line being divided into at least a line for control and a line for monitoring, even if any trouble occurs in either control data or monitor data, both types of data are prevented from affecting each other. In particular, it is possible to prevent a machine body from being stopped upon a trouble occurred in communication of the monitor data.

(3) Because of a common communication line being divided into at least a line for control and a line for monitoring, even if another monitor unit, for example, is additionally connected to the common communication line for monitoring for the purpose of function enhancement, the amount of communication data and the communication frequency to be handled via the common communication line for control are not affected, and a flexible system can be constructed.

(4) Since a display device is connected to the common communication line for monitoring, the monitor data can be displayed to the operator without causing any influences upon the control performance.

(5) Since the monitor data is displayed on the display device in the graphical form, the displayed monitor data is more easily recognizable by the operator.

(6) Since a display device is connected to both the common communication line for control and the common communication line for monitoring, not only the monitor data but also the control data can be displayed on the same display device. Even in a cab of a construction machine or the like having a relatively narrow space, therefore, it is possible to display the monitor data and the control data to the operator by installing a single unit of the display device.

(7) Since the display device displays at least one of the control data and the monitor data in the graphical form, the monitor data or the control data can be displayed to the operator in a more easily recognizable manner.

(8) Since a command signal for control or monitoring is generated and transmitted in conjunction with the contents of a display screen upon operation of input means on the display device, both a control unit and a monitor unit can be operated from the display device, thus resulting in less intricacy in the operation.

(9) Since there is no need of installing the display device in plural number, the system cost is reduced.

What is claimed is:

1. An electronic control system for a construction machine (1) comprising a prime mover (14), hydraulic equipment and systems (11–13, 19, 24–26), and a working device (7), said construction machine further comprising a plurality of control units (17, 23, 33) divided for each function and at least one monitor unit (45 or 46) for monitoring the operating status of said construction machine, said plurality of control units and said monitor unit being connected to each other for communication of control data and monitor data, wherein:

said electronic control system comprises at least two common communication lines including a first common communication line (39) for communicating said control data and a second common communication line (40) for communicating said monitor data; and said plurality of control units (17, 23, 33) are connected to said first common communication line (39) for communicating said control data among said plurality of control units via said first common communication line, and said monitor unit (45 or 46) and a particular one (17) of said plurality of control units are connected to said second common communication line (40) for communicating said monitor data between said monitor unit and said particular control unit via said second common communication line.

2. An electronic control system for a construction machine according to claim 1, further comprising a display device (47; 47A) connected to said second common communication line (40) and displaying the monitor data communicated via said second common communication line.

3. An electronic control system for a construction machine according to claim 2, wherein said display device (47; 47A) includes processing means (4710–4719; 4720–4736) for displaying the monitor data communicated via said second common communication line in graphical form.

4. An electronic control system for a construction machine according to claim 1, further comprising a display device (47A) connected to both said first and second common communication lines (39, 40) and selectively displaying the control data communicated via said first common communication line and the monitor data communicated via said second common communication line.

5. An electronic control system for a construction machine according to claim 4, wherein said display device (47A) includes processing means (4720–4736) for displaying at least one of the control data communicated via said first common communication line (39) and the monitor data communicated via said second common communication line (40) in graphical form.

6. An electronic control system for a construction machine according to claim 4, wherein said display device (47A) includes input means (4703*a*, 4703*b*, 4703*c*), generates a command signal for control and a command signal for monitoring in conjunction with contents of a display screen upon operation of said input means, transmits said command signal for control to a corresponding one (48) of said plurality of control units (17, 23, 33, 48) via said first common communication line (39), and transmits said command signal for monitoring to said monitor unit (46) via said second common communication line (40).

* * * * *